US011932928B2

(12) United States Patent
Despois et al.

(10) Patent No.: US 11,932,928 B2
(45) Date of Patent: Mar. 19, 2024

(54) HIGH STRENGTH 6XXX AND 7XXX ALUMINUM ALLOYS AND METHODS OF MAKING THE SAME

(71) Applicant: Novelis Inc., Atlanta, GA (US)

(72) Inventors: Aude Despois, Grone (CH); Guillaume Florey, Veyras (CH); Rajeev G. Kamat, Marietta, GA (US); Cyrille Bezencon, Chermignon (CH); David Leyvraz, Sierre (CH); Samuel R. Wagstaff, Marietta, GA (US)

(73) Assignee: NOVELIS INC., Atlanta, GA (US)

( * ) Notice: Subject to any disclaimer, the term of this patent is extended or adjusted under 35 U.S.C. 154(b) by 0 days.

(21) Appl. No.: 16/412,035

(22) Filed: May 14, 2019

(65) Prior Publication Data

US 2019/0352759 A1 Nov. 21, 2019

Related U.S. Application Data

(60) Provisional application No. 62/671,701, filed on May 15, 2018.

(51) Int. Cl.

| | |
|---|---|
| ***C22F 1/05*** | (2006.01) |
| ***C22C 21/04*** | (2006.01) |
| ***C22C 21/08*** | (2006.01) |

(52) U.S. Cl.

CPC ..... *C22F 1/05* (2013.01); *C22C 21/04* (2013.01); *C22C 21/08* (2013.01)

(58) Field of Classification Search

CPC ..... C22F 1/05

See application file for complete search history.

(56) References Cited

U.S. PATENT DOCUMENTS

| | | | |
|---|---|---|---|
| 4,174,232 | A | 11/1979 | Lenz et al. |
| 4,580,032 | A | 4/1986 | Carkhuff |
| 4,589,932 | A | 5/1986 | Park |

(Continued)

FOREIGN PATENT DOCUMENTS

| | | | |
|---|---|---|---|
| CN | 1526031 | A | 9/2004 |
| CN | 1867689 | A | 11/2006 |

(Continued)

OTHER PUBLICATIONS

"The Selection, Processing and Application of 6000 Series Aluminium Extrusion Alloys", Technical Report No. 6, by Comalco Smelting, p. 1-11. (Year: 2001).*

(Continued)

*Primary Examiner* — George Wyszomierski
*Assistant Examiner* — Janell C Morillo
(74) *Attorney, Agent, or Firm* — Kilpatrick Townsend & Stockton LLP

(57) ABSTRACT

Provided are new high strength 6xxx and 7xxx series aluminum alloys and methods of making aluminum products thereof. These aluminum products may be used to fabricate components which may replace steel in a variety of applications including the automotive industry. In some examples, the disclosed high strength 6xxx and 7xxx series aluminum alloys can replace high strength steels with aluminum. In one example, steels having a yield strength below 450 MPa may be replaced with the disclosed 6xxx or 7xxx series aluminum alloys without the need for major design modifications.

10 Claims, 7 Drawing Sheets

(56) References Cited

U.S. PATENT DOCUMENTS

| | | | | |
|---|---|---|---|---|
| 4,637,842 | A | 1/1987 | Jeffrey et al. | |
| 5,620,652 | A | 4/1997 | Tack et al. | |
| 5,662,750 | A | 9/1997 | Shen | |
| 5,690,758 | A | 11/1997 | Oh et al. | |
| 5,961,752 | A | 10/1999 | Bergsma | |
| 6,004,506 | A | 12/1999 | Chu et al. | |
| 6,120,623 | A | 9/2000 | Gupta et al. | |
| 6,231,809 | B1 | 5/2001 | Matsumoto et al. | |
| 6,280,543 | B1 | 8/2001 | Zonker et al. | |
| 6,537,392 | B2 | 3/2003 | Magnusen et al. | |
| 6,695,935 | B1 | 2/2004 | Haszler et al. | |
| 8,728,256 | B2 | 5/2014 | Che et al. | |
| 8,758,529 | B2 | 6/2014 | Wang et al. | |
| 8,999,079 | B2 * | 4/2015 | Kamat | C22C 21/14 148/417 |
| 9,217,622 | B2 | 12/2015 | Mooy et al. | |
| 9,828,652 | B2 | 11/2017 | Kamat et al. | |
| 9,834,828 | B2 | 12/2017 | Doty | |
| 9,870,841 | B2 | 1/2018 | Yoshida et al. | |
| 9,890,443 | B2 | 2/2018 | Lin et al. | |
| 10,096,394 | B2 | 10/2018 | Sekiya et al. | |
| 10,513,766 | B2 | 12/2019 | Ahmed et al. | |
| 10,533,243 | B2 | 1/2020 | Newman et al. | |
| 10,550,455 | B2 | 2/2020 | Hosch et al. | |
| 2002/0005232 | A1 | 1/2002 | Matsuda et al. | |
| 2002/0017344 | A1 | 2/2002 | Gupta et al. | |
| 2003/0143102 | A1 | 7/2003 | Matsuoka et al. | |
| 2004/0094249 | A1 | 5/2004 | Uchida et al. | |
| 2004/0177902 | A1 | 9/2004 | Mergen et al. | |
| 2004/0187985 | A1 | 9/2004 | Matsumoto et al. | |
| 2005/0028894 | A1 | 2/2005 | Hoffmann et al. | |
| 2005/0288894 | A1 | 12/2005 | Vorenkamp et al. | |
| 2008/0145266 | A1 | 6/2008 | Chen et al. | |
| 2008/0175747 | A1 | 7/2008 | Kajihara et al. | |
| 2009/0242088 | A1 | 10/2009 | Takaki et al. | |
| 2010/0059151 | A1 | 3/2010 | Iwamura et al. | |
| 2011/0017055 | A1 | 1/2011 | Mooy et al. | |
| 2011/0250469 | A1 | 10/2011 | De Smet et al. | |
| 2012/0000578 | A1 | 1/2012 | Wang et al. | |
| 2012/0055590 | A1 | 3/2012 | Kamat et al. | |
| 2012/0055591 | A1 | 3/2012 | Kamat et al. | |
| 2012/0152414 | A1 | 6/2012 | Che et al. | |
| 2013/0334091 | A1 | 12/2013 | Sawtell et al. | |
| 2014/0003993 | A1 | 1/2014 | Matsumoto et al. | |
| 2014/0083575 | A1 | 3/2014 | Minoda et al. | |
| 2014/0248177 | A1 | 9/2014 | Kamat et al. | |
| 2014/0290809 | A1 | 10/2014 | Hori et al. | |
| 2014/0366997 | A1 | 12/2014 | Kamat et al. | |
| 2014/0366998 | A1 | 12/2014 | Kamat et al. | |
| 2014/0366999 | A1 | 12/2014 | Kamat et al. | |
| 2015/0007909 | A1 | 1/2015 | Matsumoto et al. | |
| 2015/0050520 | A1 | 2/2015 | Niikura et al. | |
| 2015/0315688 | A1 | 11/2015 | Doty | |
| 2015/0316210 | A1 | 11/2015 | Nakai et al. | |
| 2015/0376741 | A1 | 12/2015 | Kobayashi et al. | |
| 2016/0002761 | A1 * | 1/2016 | De Smet | C22F 1/047 148/552 |
| 2016/0201158 | A1 | 7/2016 | Kamat et al. | |
| 2016/0305000 | A1 | 10/2016 | Aruga et al. | |
| 2017/0175240 | A1 | 6/2017 | Wen et al. | |
| 2017/0204503 | A1 * | 7/2017 | Aruga | C22F 1/047 |
| 2017/0250000 | A1 | 8/2017 | Sekiya et al. | |
| 2017/0283913 | A1 * | 10/2017 | Koshino | C22C 21/08 |
| 2018/0044755 | A1 | 2/2018 | Kamat et al. | |
| 2018/0117650 | A1 | 5/2018 | Felberbaum et al. | |

FOREIGN PATENT DOCUMENTS

| | | | |
|---|---|---|---|
| CN | 101484598 | | 7/2009 |
| CN | 101880801 | | 11/2010 |
| CN | 101935785 | | 1/2011 |
| CN | 104321451 | | 1/2015 |
| CN | 106414782 | | 2/2017 |
| CN | 106978553 | A | 7/2017 |
| CN | 106978557 | A | 7/2017 |
| CN | 107667184 | | 2/2018 |
| EP | 1170118 | | 1/2002 |
| EP | 1195449 | | 4/2002 |
| EP | 2075348 | | 7/2009 |
| EP | 3124633 | | 2/2017 |
| FR | 2922222 | | 4/2009 |
| GB | 650905 | | 3/1951 |
| JP | H0293049 | | 4/1990 |
| JP | 5112840 | | 5/1993 |
| JP | H06503854 | | 4/1994 |
| JP | 6240424 | | 8/1994 |
| JP | H07286251 | | 10/1995 |
| JP | H0860285 | | 3/1996 |
| JP | 9209068 | | 8/1997 |
| JP | 10130768 | | 5/1998 |
| JP | 2000160310 | | 6/2000 |
| JP | 2002206152 | | 7/2002 |
| JP | 2004043907 | | 2/2004 |
| JP | 2004534152 | | 11/2004 |
| JP | 2005042187 | | 2/2005 |
| JP | 2006009140 | | 1/2006 |
| JP | 2007009262 | | 1/2007 |
| JP | 2007510061 | | 4/2007 |
| JP | 2009263720 | A | 11/2009 |
| JP | 2011006736 | | 1/2011 |
| JP | 2013542320 | | 11/2013 |
| JP | 2015034330 | | 2/2015 |
| JP | 2015528856 | | 10/2015 |
| JP | 2015193903 | | 11/2015 |
| RU | 2327758 | | 6/2008 |
| RU | 2394113 | | 7/2010 |
| WO | 9859086 | | 12/1998 |
| WO | 003052 | | 1/2000 |
| WO | 015859 | | 3/2000 |
| WO | 070115 | | 11/2000 |
| WO | 192591 | | 12/2001 |
| WO | 2099151 | | 12/2002 |
| WO | 2004001086 | | 12/2003 |
| WO | 2005100623 | | 10/2005 |
| WO | 2008123355 | | 10/2008 |
| WO | 2008152919 | | 12/2008 |
| WO | 2009059826 | | 5/2009 |
| WO | 2009093559 | | 7/2009 |
| WO | 2009119724 | | 10/2009 |
| WO | 2009123011 | | 10/2009 |
| WO | 2010029572 | | 3/2010 |
| WO | 2010119070 | | 10/2010 |
| WO | 2012033954 | | 3/2012 |
| WO | 2012070803 | | 5/2012 |
| WO | 2013118734 | | 8/2013 |
| WO | 2013133978 | | 9/2013 |
| WO | 2014046010 | | 3/2014 |
| WO | 2014126073 | | 8/2014 |
| WO | 2014168147 | | 10/2014 |
| WO | 2015030598 | | 3/2015 |
| WO | 2015034024 | | 3/2015 |
| WO | 2015098484 | | 7/2015 |
| WO | 2015109893 | | 7/2015 |
| WO | 2015127805 | | 9/2015 |
| WO | 2015133004 | | 9/2015 |
| WO | 2015144302 | | 10/2015 |
| WO | 2015146654 | | 10/2015 |
| WO | 2015151886 | | 10/2015 |
| WO | 2015151907 | | 10/2015 |
| WO | 2016069695 | | 5/2016 |
| WO | 2017106665 | | 6/2017 |

OTHER PUBLICATIONS

International Alloy Designations and Chemical Composition Limits for Wrought Aluminum and Wrought Aluminum Alloys, The Aluminum Association, Inc., Registration Record Series, Teal Sheets, Feb. 1, 2009, 35 pages.

Daiming, Metal Material Science, Southwest Jiaotong University Press, Jun. 30, 2014, 5 pages.

(56) References Cited

OTHER PUBLICATIONS

Hinesley et al., The Effect of Structure on the Strain Rate Sensitivity of 3003 Al—Mn Alloy, Materials Science and Engineering, vol. 6, Issue 1, Jul. 1970, pp. 48-54.
Jiarong, Q&A on Production Technology of Aluminum Alloy Casting, Metallurgical Industry Press, Jan. 31, 2008, 6 pages.
Lei et al., Analysis of Strengthening Factors in Thermomechanical Treatment of an Al—Cu—Mg—Mn Alloy, Department of Metals and Technology, 1982, pp. 307-312.
Morris, Dynamic Strain Aging in Aluminum Alloys, Materials Science and Engineering, vol. 13, Issue 2, Feb. 1974, pp. 101-108.
Morris, Superstrength Aluminum Alloys, Materials Science and Engineering, vol. 9, Jan. 1972, pp. 361-367.
Morris, The Deformational Instability of Aluminum Alloys, Materials Science and Engineering, vol. 3, Issue 4, Nov. 1968, pp. 220-230.
Morris et al., The Effect of Strain Rate on the Deformational Instability of Aluminum Alloys, Materials Science and Engineering, vol. 4, Issue 4, Jul. 1969, pp. 198-205.
Morris et al., The Warm and Hot Working of Dynamically Strain Ageable Aluminum Alloys, Materials Science and Engineering, vol. 17, Issue 1, Jan. 1975, pp. 77-80.
Niranjani et al., Development of High Strength Al—Mg—Si AA6061 Alloy Through Cold Rolling and Ageing, Materials Science and Engineering A, vol. 515, Nos. 1-2, Jul. 25, 2009, pp. 169-174.
International Application No. PCT/US2019/032246, International Search Report and Written Opinion dated Aug. 8, 2019, 13 pages.
Wang et al., Improving the Strength and Ductility of Al—Mg—Si—Cu Alloys by a Novel Thermo-Mechanical Treatment, Materials Science and Engineering: A, vol. 607, Jun. 23, 2014, pp. 313-317.
Yuanyuan, New Materials, Science and Technology Metallic Material Volume, South China University of Technology Press, Sep. 30, 2012, 6 pages.
Chinese Application No. 201980032395.4, Office Action, dated Jun. 23, 2021, 20 pages.
"Heat Treatment of Aluminum Alloy Raw Materials", Auszug Norm AMS 2772F, Jul. 2011.
"International Alloy Designations and Chemical Composition Limits for Wrought Aluminum and Wrought Aluminum Alloys", The Aluminium Association, Registration Record Series Teel Sheets, 2006, 38 pages.
Davis , "Aluminum and Aluminum Alloys", ASM Specialty Handbook, 1993, pp. 1-3.
Davydov et al., "TTP and TTT Diagrams for Quench Sensitivity of 6016 Alloy", Aluminum Alloys, vol. 2, 1998, 6 pages.
Graf et al., "The Influence of Strain-Path Changes on Forming Limit Diagrams of Al 6111 T4", International Journal of Mechanical Sciences, vol. 36, No. 10, 1994, pp. 897-910.
Kim et al., "Effects of Cu Addition on Behavior of Nanoclusters during Multi-Step Aging in Al—Mg—Si Alloys", Materials Transactions, vol. 52, No. 5, 2011, pp. 906-913.
Mukhopadhyay , "Alloy Designation, Processing, and Use of AA6XXX Series Aluminium Alloys", ISRN Metallurgy, vol. 12, Article ID 165082, Feb. 2012, pp. 1-15.
Prillhofer et al., "Characterization of the Artificial Aging Behavior and Formability of a High Strength EN AW-6016 at Different Heat Treatment Conditions Used for Automotive Applications", Sep. 2012.
"Aluminum Handbook", General Incorporated Association, Japan Aluminium Association, Standard Committee, 7th Edition, Jan. 31, 2007, pp. 5-14.
"International Alloy Designations and Chemical Composition Limits for Wrought Aluminum and Wrought Aluminum Alloys", The Aluminium Association, Registration Record Series Teal Sheets, Jan. 2015, 38 pages.
Canadian Application No. 3,099,800 , Office Action, dated Oct. 29, 2021, 4 pages.
Chinese Application No. 201980032395.4 , Office Action, dated Jan. 24, 2022, 14 pages.
Japanese Application No. 2020-564125 , Office Action, dated Jan. 5, 2022, 19 pages.
Korean Application No. 10-2020-7032529 , Office Action, dated Mar. 11, 2022, 10 pages.
Indian Application No. 202017048995 , "First Examination Report", dated May 20, 2022, 6 pages.
Canadian Application No. 3,099,800 , "Office Action", dated Jun. 9, 2022, 4 pages.
Chinese Application No. 201980032395.4 , "Office Action", dated May 24, 2022, 21 pages.
Japanese Application No. 2020-564125 , "Notice of Decision to Grant", dated Jun. 14, 2022, 4 pages.
"Rolling Aluminum: From the Mine Through the Mill", The Aluminum Association, 3rd Edition, Dec. 2007, 8 pages.
Chinese Application No. 201980032395.4 , "Office Action", dated Aug. 26, 2022, 10 pages.
Korean Application No. 10-2020-7032529 , "Office Action", dated Sep. 28, 2022, 10 pages.
Canadian Application No. 3,099,800 , "Office Action", dated Feb. 6, 2023, 3 pages.
Korean Application No. 10-2020-7032529 , "Notice of Decision to Grant", dated Mar. 22, 2023, 5 pages.
Li , "Modern Material Science and Engineering Dictionary", Shandong Science and Technology Press, Aug. 2001, 2 pages.
"English Translation of CN 101880801 A", Nov. 10, 2010, 9 pages.
"English Translation of CN 101935785 A", Jan. 5, 2011, 11 pages.
"English Translation of JP 05112840 A", May 7, 1993, 15 pages.
"English Translation of JP 06240424 A", Aug. 30, 1994, 5 pages.
"English Translation of JP 09209068 A", Aug. 12, 1997, 7 pages.
"English Translation of JP 10130768 A", May 19, 1998, 10 pages.
"English Translation of JP 2000160310 A", Jun. 13, 2000, 15 pages.
"Excerpt duden.de/", Aug. 25, 2021, 3 pages.
"Excerpt Norm AMS 2772", Jul. 2011, 3 pages.
"Original Application Documents", Jun. 22, 2017, 58 pages.
European Application No. 19727251.1 , "Office Action", dated Nov. 9, 2023, 3 pages.
Canadian Application No. 3,099,800 , "Notice of Allowance", dated Nov. 6, 2023, 1 page.

* cited by examiner

HIGH STRENGTH 6XXX AND 7XXX ALUMINUM ALLOYS AND METHODS OF MAKING THE SAME

CROSS-REFERENCE TO RELATED APPLICATION

This application claims the benefit of U.S. Provisional Patent Application No. 62/671,701, filed May 15, 2018, which is incorporated by reference herein in its entirety.

FIELD

Provided herein are new high strength 6xxx and 7xxx series aluminum alloys and methods of manufacturing these alloys. These alloys display improved mechanical properties, including greater strength as compared to alloys prepared by alternative methods.

BACKGROUND

Recyclable aluminum alloys with high strength are desirable for improved product performance in many applications, including transportation (encompassing without limitation, e.g., trucks, trailers, trains, and marine) applications, electronic applications, and automobile applications. For example, a high strength aluminum alloy in trucks or trailers would be lighter than conventional steel alloys, providing significant emission reductions that are needed to meet new, stricter government regulations on emissions. Such alloys should exhibit high strength, high formability, and corrosion resistance.

SUMMARY OF THE INVENTION

Covered embodiments of the invention are defined by the claims, not this summary. This summary is a high-level overview of various aspects of the invention and introduces some of the concepts that are further described in the figures and in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Disclosed are high strength 6xxx series aluminum alloys compositions having a yield strength and/or a tensile strength of greater than 450 MPa. Elemental compositions of 6xxx series aluminum alloys described herein can include about 0.6-1.0 wt. % Cu, about 0.8-1.5 wt. % Si, about 0.8-1.5 wt. % Mg, about 0.03-0.25 wt. % Cr, about 0.05-0.25 wt. % Mn, about 0.15-0.4 wt. % Fe, up to about 0.2 wt. % Zr, up to about 0.2 wt. % Sc, up to about 0.25 wt. % Sn, up to about 0.9 wt. % Zn, up to about 0.1 wt. % Ti, up to about 0.07 wt. % Ni, up to about 0.15 wt. % of impurities, and Al. In some non-limiting examples, a 6xxx series aluminum alloy as described herein can include about 0.5-2.0 wt. % Cu, about 0.5-1.5 wt. % Si, about 0.5-1.5 wt. % Mg, about 0.001-0.25 wt. % Cr, about 0.005-0.4 wt. % Mn, about 0.1-0.3 wt. % Fe, up to about 0.2 wt. % Zr, up to about 0.2 wt. % Sc, up to about 0.25 wt. % Sn, up to about 4.0 wt. % Zn, up to about 0.15 wt. % Ti, up to about 0.1 wt. % Ni, up to about 0.15 wt. % of impurities, and Al. In some further non-limiting examples, a 6xxx series aluminum alloy as described herein can include about 0.5-2.0 wt. % Cu, about 0.5-1.35 wt. % Si, about 0.6-1.5 wt. % Mg, about 0.001-0.18 wt. % Cr, about 0.005-0.4 wt. % Mn, about 0.1-0.3 wt. % Fe, up to about 0.2 wt. % Zr, up to about 0.2 wt. % Sc, up to about 0.25 wt. % Sn, up to about 0.9 wt. % Zn, up to about 0.15 wt. % Ti, up to about 0.1 wt. % Ni, up to about 0.15 wt. % of impurities, and Al. In still further non-limiting examples, a 6xxx series aluminum alloy as described herein can include about 0.6-0.9 wt. % Cu, about 0.7-1.1 wt. % Si, about 0.9-1.5 wt. % Mg, about 0.06-0.15 wt. % Cr, about 0.05-0.3 wt. % Mn, about 0.1-0.3 wt. % Fe, up to about 0.2 wt. % Zr, up to about 0.2 wt. % Sc, up to about 0.25 wt. % Sn, up to about 0.2 wt. % Zn, up to about 0.15 wt. % Ti, up to about 0.07 wt. % Ni, up to about 0.15 wt. % of impurities, and Al. In still further non-limiting examples, a 6xxx series aluminum alloy as described herein can include about 0.9-1.5 wt. % Cu, about 0.7-1.1 wt. % Si, about 0.7-1.2 wt. % Mg, about 0.06-0.15 wt. % Cr, about 0.05-0.3 wt. % Mn, about 0.1-0.3 wt. % Fe, up to about 0.2 wt. % Zr, up to about 0.2 wt. % Sc, up to about 0.25 wt. % Sn, up to about 0.2 wt. % Zn, up to about 0.15 wt. % Ti, up to about 0.07 wt. % Ni, up to about 0.15 wt. % of impurities, and Al.

Also disclosed are high strength 7xxx series aluminum alloy compositions having a yield strength and/or a tensile strength greater than 500 MPa.

Also disclosed are methods of manufacturing these new high strength 6xxx and 7xxx series aluminum alloy compositions. A method of making an aluminum alloy product can include casting a 6xxx series aluminum alloy, rapidly heating the cast aluminum alloy to a temperature between about 510° C. and about 580° C., maintaining the cast aluminum alloy at the temperature between about 510° C. and about 580° C. for 0.5 to 100 hours, and hot rolling the cast aluminum alloy into the aluminum alloy product. The aluminum alloy product can have a thickness up to about 12 mm and a hot roll exit temperature between about 30° C. and about 400° C. The aluminum alloy product can be subjected to heat treating at a temperature between about 520° C. and about 590° C. The heat treating may be followed by quenching to ambient temperature. The aluminum alloy product can then be under-aged followed by cold rolling to a final gauge, wherein the cold rolling results in a thickness reduction of about 10% to about 80%. The aluminum alloy product can then be re-aged.

A method of making an aluminum alloy product can include casting a 7xxx series aluminum alloy, rapidly heating the cast aluminum alloy to a temperature between about 400° C. and about 600° C., maintaining the cast aluminum alloy at the temperature between about 400° C. and about 600° C. for 0.5 to 100 hours, and hot rolling the cast aluminum alloy into an aluminum alloy product. The aluminum alloy product can have a thickness up to about 12 mm and a hot roll exit temperature between about 30° C. and about 400° C. The aluminum alloy product can be subjected to heat treating at a temperature between about 460° C. to about 600° C. The heat treating may be followed by quenching to ambient temperature. The aluminum alloy product can then be under-aged followed by cold rolling to a final gauge, wherein the cold rolling results in a thickness reduction of about 10% to about 80%. The aluminum alloy product can then be re-aged. In some aspects, the sample may be sent directly for heat treatment following quenching. In further aspects, the sample may be pre-aged as described herein.

Another method of making an aluminum alloy product can include casting a 6xxx series aluminum alloy, rapidly heating the cast aluminum alloy to a temperature between about 510° C. and about 580° C., maintaining the cast aluminum alloy at the temperature between about 510° C. and about 580° C. for 0.5 to 100 hours, and hot rolling the cast aluminum alloy into the aluminum alloy product. The aluminum alloy product can be quenched at an exit from hot rolling at an exit temperature between about 200° C. and about 300° C. The rolled aluminum alloy product can have a thickness up to about 12 mm. The aluminum alloy product can then be under-aged followed by cold rolling to a final gauge, wherein the cold rolling results in a thickness reduction of about 10% to about 80%. The aluminum alloy product can then be re-aged.

The 6xxx and 7xxx series aluminum alloy products produced by the methods described above can achieve a yield strength of greater than 450 MPa and/or a tensile strength of greater than 500 MPa, while maintaining a uniform elongation, e.g., of at least 5%.

In some examples, a method of making an aluminum alloy product can include continuously casting a 6xxx series aluminum alloy, hot rolling the cast aluminum alloy into the aluminum alloy product, the hot rolling having an entry temperature of about 450° C. to about 540° C. and an exit temperature of 30° C. to 400° C., the rolled aluminum alloy product having a first gauge from 5 to 12 mm. The aluminum alloy product can then be rapidly heated to a temperature of about 510° C. to about 580° C., maintaining the temperature of about 510° C. to about 580° C. for 0.5 to 100 hours, cold rolling the aluminum alloy product to a first gauge of 2 to 4 mm, and solution heat treating the aluminum alloy product at a temperature of about 520° C. to about 590° C. The aluminum alloy product may then be quenched to ambient temperature, optionally pre-aged, under-aged, cold rolled, and then re-aged.

In further examples, a method of making an aluminum alloy product can include the following steps: continuously casting a 6xxx series aluminum alloy, hot rolling the cast aluminum alloy into the aluminum alloy product, the hot rolling having an entry temperature of about 300° C. to about 500° C. (e.g., about 450° C. to about 500° C.) and an exit temperature of no more than approximately 470° C., the rolled aluminum alloy product having a first gauge from 5 to 12 mm; rapidly heating the rolled aluminum alloy product to a temperature of about 400° C. to about 590° C.; maintaining the rolled aluminum alloy at the temperature of about 400° C. to about 590° C. for up to about 30 minutes; quenching the aluminum alloy product to ambient temperature; under-ageing the aluminum alloy product; cold rolling the under-aged aluminum alloy product to a final gauge of 2 to 5 mm with a cold reduction between the first and final gauge of 20 to 80%; and re-ageing the cold rolled aluminum alloy product. In some aspects, the sample may be sent directly for heat treatment following quenching. In further aspects, the sample may be pre-aged as described herein.

The 6xxx or 7xxx series aluminum alloy products produced by the methods described above can achieve a yield strength and/or a tensile strength of at least 450 MPa (e.g., at least 500 MPa) while maintaining an elongation of at least 5%.

These new high strength 6xxx and 7xxx series aluminum alloy products have many uses in the transportation industry and can replace steel components to produce lighter weight vehicles. Such vehicles include, without limitation, automobiles, vans, campers, mobile homes, trucks, bodies in white, cabs of trucks, trailers, buses, motorcycles, scooters, bicycles, boats, ships, shipping containers, trains, train engines, rail passenger cars, rail freight cars, planes, drones, and spacecraft. For example, the new aluminum alloy products can be used in battery plates and cases, rocker components, cross members, and lateral reinforcements in the automotive industry.

The new high strength 6xxx and 7xxx series aluminum alloy products may be used to replace steel components, such as in a chassis or a component part of a chassis. These new high strength 6xxx and 7xxx series aluminum alloy products may also be used, without limitation, in vehicle parts, for example train parts, ship parts, truck parts, bus parts, aerospace parts, bodies in white of vehicles, and car parts.

The high strength 6xxx and 7xxx series aluminum alloy products can replace high strength steels with aluminum. In one example, steels having a yield strength below 450 MPa may be replaced with the disclosed 6xxx and 7xxx series aluminum alloy products without the need for major design modifications, except for adding stiffeners when required, where stiffeners refer to extra added metal plates or rods when required by design.

These new high strength 6xxx and 7xxx series aluminum alloy products may be used in other applications that require high strength without a major decrease in ductility (i.e., maintaining a total elongation of at least 5%. For example, these high strength 6xxx and 7xxx series aluminum alloy products can be used in electronics applications and in specialty products including, without limitation, electronic components and parts of electronic devices.

Other objects and advantages will be apparent from the following detailed description of non-limiting examples.

DETAILED DESCRIPTION

Figure 1:
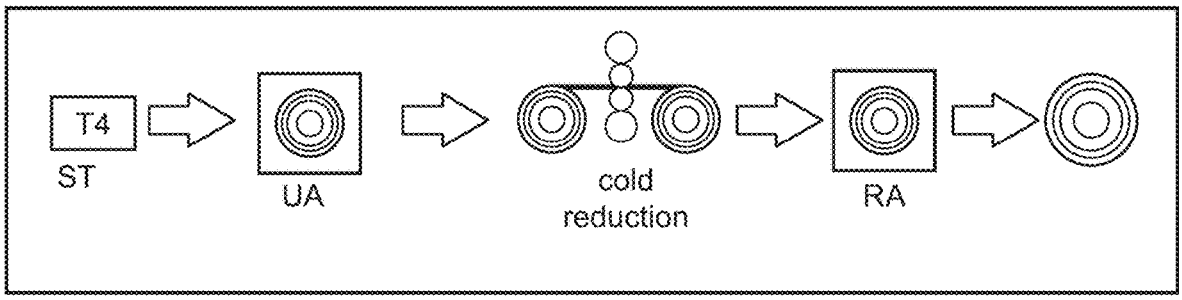
FIG. 1 is a schematic representation of a method of manufacturing high strength 6xxx series aluminum alloys according to one example.

Definitions and Descriptions:

As used herein, the terms "invention," "the invention," "this invention," and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "6xxx," "7xxx," and "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association. In some aspects used herein, AA numbers and related designations, such as 6xxx or 7xxx series, can refer to a modified AA number or series that is derived from but deviates from the traditional designation.

As used herein, the meaning of "a," "an," and "the" includes singular and plural references unless the context clearly dictates otherwise.

As used herein, a plate generally has a thickness of greater than about 15 mm. For example, a plate may refer to an aluminum alloy product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum alloy product having a thickness of less than about 4 mm. For example, a sheet may have a thickness of less than about 4 mm, less than about 3 mm, less than about 2 mm, less than about 1 mm, less than about 0.5 mm, less than about 0.3 mm, or less than about 0.1 mm.

Reference may be made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. An Hxx condition or temper, also referred to herein as an H temper, refers to an aluminum alloy after cold rolling with or without thermal treatment (e.g., annealing). Suitable H tempers include HX1, HX2, HX3 HX4, HX5, HX6, HX7, HX8, or HX9 tempers, along with Hxxx temper variations (e.g., H111), which are used for a particular alloy temper when the degree of temper is close to the Hxx temper. A Ti condition or temper refers to an aluminum alloy cooled from hot working and naturally aged (e.g., at ambient temperature). A T2 condition or temper refers to an aluminum alloy cooled from hot working, cold worked and naturally aged. A T3 condition or temper refers to an aluminum alloy solution heat treated, cold worked, and naturally aged. A T4 condition or temper refers to an aluminum alloy solution heat treated and naturally aged. A T5 condition or temper refers to an aluminum alloy cooled from hot working and artificially aged (at elevated temperatures). A T6 condition or temper refers to an aluminum alloy solution heat treated, quenched, and artificially aged. A T61 condition or temper refers to an aluminum alloy solution heat treated, quenched, naturally aged for a period of time, and then artificially aged. A T7 condition or temper refers to an aluminum alloy solution heat treated and artificially overaged. A T8x condition or temper (e.g., T8) refers to an aluminum alloy solution heat treated, cold worked, and artificially aged. A T9x condition or temper refers to an aluminum alloy solution heat treated, artificially aged, and cold worked.

As used herein, terms such as "cast metal product," "cast product," "cast aluminum alloy product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

As used herein, the meaning of "ambient temperature" can include a temperature of from about −10° C. to about 60° C. Ambient temperature may also be about 0° C., about 10° C., about 20° C., about 30° C., about 40° C., or about 50° C.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

Alloy Compositions

Described below are novel 6xxx and 7xxx series aluminum alloys. In certain aspects, the alloys exhibit high strength, high formability, and corrosion resistance. The properties of the alloys are achieved due to in part to the composition of the alloys and in part to the methods of processing the alloys to produce the described products (i.e., plates, shates, and sheets). In certain aspects, the alloys can have the following elemental composition as provided in Table 1:

TABLE 1

| Element | Weight Percentage (wt. %) |
|---|---|
| Cu | 0.9-1.5 |
| Si | 0.7-1.1 |
| Mg | 0.7-1.2 |
| Cr | 0.06-0.15 |
| Mn | 0.05-0.3 |
| Fe | 0.1-0.3 |
| Zr | 0-0.2 |
| Sc | 0-0.2 |
| Sn | 0-0.25 |
| Zn | 0-0.2 |
| Ti | 0-0.15 |
| Ni | 0-0.07 |
| Others | 0-0.05 (each)<br>0-0.15 (total) |
| Al | |

In other examples, the alloys can have the following elemental composition as provided in Table 2:

TABLE 2

| Element | Weight Percentage (wt. %) |
|---|---|
| Cu | 0.6-0.9 |
| Si | 0.8-1.3 |
| Mg | 0.8-1.3 |
| Cr | 0.03-0.25 |
| Mn | 0.05-0.2 |
| Fe | 0.15-0.3 |
| Zr | 0-0.2 |
| Sc | 0-0.2 |
| Sn | 0-0.25 |
| Zn | 0-0.9 |
| Ti | 0-0.1 |
| Ni | 0-0.07 |
| Others | 0-0.05 (each)<br>0-0.15 (total) |
| Al | |

In other examples, the alloys can have the following elemental composition as provided in Table 3:

TABLE 3

| Element | Weight Percentage (wt. %) |
|---|---|
| Cu | 0.5-2.0 |
| Si | 0.5-1.5 |
| Mg | 0.5-1.5 |
| Cr | 0.001-0.25 |
| Mn | 0.005-0.4 |
| Fe | 0.1-0.3 |
| Zr | 0-0.2 |
| Sc | 0-0.2 |
| Sn | 0-0.25 |
| Zn | 0-4.0 |
| Ti | 0-0.15 |
| Ni | 0-0.1 |
| Others | 0-0.05 (each)<br>0-0.15 (total) |
| Al | |

In one example, an aluminum alloy can have the following elemental composition as provided in Table 4:

TABLE 4

| Element | Weight Percentage (wt. %) |
|---|---|
| Cu | 0.6-0.9 |
| Si | 0.8-1.3 |
| Mg | 0.8-1.3 |
| Cr | 0.03-0.15 |
| Mn | 0.05-0.2 |
| Fe | 0.15-0.3 |
| Zr | 0-0.2 |
| Sc | 0-0.2 |
| Sn | 0-0.25 |
| Zn | 0-0.9 |
| Ti | 0-0.1 |
| Ni | 0-0.07 |
| Others | 0-0.05 (each)<br>0-0.15 (total) |
| Al | |

In another example, an aluminum alloy can have the following elemental composition as provided in Table 5:

TABLE 5

| Element | Weight Percentage (wt. %) |
|---|---|
| Cu | 0.65-0.9 |
| Si | 0.9-1.15 |
| Mg | 0.8-1.3 |
| Cr | 0.03-0.15 |
| Mn | 0.05-0.18 |
| Fe | 0.18-0.25 |
| Zr | 0.01-0.2 |
| Sc | 0-0.2 |
| Sn | 0-0.2 |
| Zn | 0.001-0.9 |
| Ti | 0-0.1 |
| Ni | 0-0.05 |
| Others | 0-0.05 (each)<br>0-0.15 (total) |
| Al | |

In another example, an aluminum alloy can have the following elemental composition as provided in Table 6:

TABLE 6

| Element | Weight Percentage (wt. %) |
|---|---|
| Cu | 0.65-0.9 |
| Si | 1.0-1.1 |
| Mg | 0.8-1.25 |
| Cr | 0.05-0.12 |
| Mn | 0.08-0.15 |
| Fe | 0.15-0.2 |
| Zr | 0.01-0.15 |
| Sc | 0-0.15 |
| Sn | 0-0.2 |
| Zn | 0.004-0.9 |
| Ti | 0-0.03 |
| Ni | 0-0.05 |
| Others | 0-0.05 (each)<br>0-0.15 (total) |
| Al | |

In certain examples, the disclosed alloy includes copper (Cu) in an amount from about 0.6% to about 0.9% (e.g., from 0.65% to 0.9%, from 0.7% to 0.9%, or from 0.6% to 0.7%) based on the total weight of the alloy. For example, the alloy can include 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, or 0.9% Cu. All expressed in wt. %.

In certain examples, the disclosed alloy includes silicon (Si) in an amount from about 0.8% to about 1.3% (e.g., from 0.8% to 1.2%, from 0.9% to 1.2%, from 0.8% to 1.1%, from 0.9% to 1.15%, from 1.0% to 1.1%, or from 1.05 to 1.2%) based on the total weight of the alloy. For example, the alloy can include 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, or 1.3% Si. All expressed in wt. %.

In certain examples, the disclosed alloy includes magnesium (Mg) in an amount from about 0.8% to about 1.3% (e.g., from 0.8% to 1.25%, from 0.85% to 1.25%, from 0.8% to 1.2%, or from 0.85% to 1.2%) based on the total weight of the alloy. For example, the alloy can include 0.8%, 0.81%, 0.82%, 0.83%, 0.84%, 0.85%, 0.86%, 0.87%, 0.88%, 0.89%, 0.90%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, or 1.3% Mg. All expressed in wt. %.

In certain aspects, Cu, Si and Mg can form precipitates in the alloy to result in an alloy with higher strength. These precipitates can form during the ageing processes, after solution heat treatment. During the precipitation process, metastable Guinier Preston (GP) zones can form, which in turn transfer to β" needle-shaped precipitates that contribute to precipitation strengthening of the disclosed alloys. In certain aspects, addition of Cu leads to the formation of lathe-shaped L phase precipitation, which is a precursor of Q' precipitate phase formation and which further contributes to strength. In certain aspects, the Cu and Si/Mg ratios are controlled to avoid detrimental effects to corrosion resistance.

In certain aspects, for a combined effect of strengthening, formability and corrosion resistance, the alloy has a Cu content of less than about 0.9 wt. % along with a controlled Si to Mg ratio and a controlled excess Si range, as further described below.

The Si to Mg ratio may be from about 0.55:1 to about 1.30:1 by weight. For example, the Si to Mg ratio may be from about 0.6:1 to about 1.25:1 by weight, from about 0.65:1 to about 1.2:1 by weight, from about 0.7:1 to about 1.15:1 by weight, from about 0.75:1 to about 1.1:1 by weight, from about 0.8:1 to about 1.05:1 by weight, from about 0.85:1 to about 1.0:1 by weight, or from about 0.9:1 to about 0.95:1 by weight. In certain aspects, the Si to Mg ratio is from 0.8:1 to 1.15:1. In certain aspects, the Si to Mg ratio is from 0.85:1 to 1:1.

In certain aspects, the alloy may use an almost balanced Si to slightly under-balanced Si approach in alloy design instead of a high excess Si approach. In certain aspects, excess Si is about −0.5 to 0.1. Excess Si as used herein is defined by the equation:

$$\text{Excess Si}=(\text{alloy wt. \% Si})-[(\text{alloy wt. \% Mg})-1/6\times(\text{alloy wt. \% Fe+Mn+Cr})].$$

For example, excess Si can be −0.50, −0.49, −0.48, −0.47, −0.46, −0.45, −0.44, −0.43, −0.42, −0.41, −0.40, −0.39, −0.38, −0.37, −0.36, −0.35, −0.34, −0.33, −0.32, −0.31, −0.30, −0.29, −0.28, −0.27, −0.26, −0.25, −0.24, −0.23, −0.22, −0.21, −0.20, −0.19, −0.18, −0.17, −0.16, −0.15, −0.14, −0.13, −0.12, −0.11, −0.10, −0.09, −0.08, −0.07, −0.06, −0.05, −0.04, −0.03, −0.02, −0.01, 0, 0.01, 0.02, 0.03, 0.04, 0.05, 0.06, 0.07, 0.08, 0.09, or 0.10. In certain aspects, the alloy has Cu<0.9 wt. %, the Si/Mg ratio is 0.85-0.1, and excess Si is −0.5-0.1.

In certain aspects, the alloy includes chromium (Cr) in an amount from about 0.03% to about 0.25% (e.g., from 0.03% to 0.15%, from 0.05% to 0.13%, from 0.075% to 0.12%, from 0.03% to 0.04%, from 0.08% to 0.15%, from 0.03% to 0.045%, from 0.04% to 0.06%, from 0.035% to 0.045%, from 0.04% to 0.08%, from 0.06% to 0.13%, from 0.06% to 0.22%, from 0.1% to 0.13%, or from 0.11% to 0.23%) based on the total weight of the alloy. For example, the alloy can include 0.03%, 0.035%, 0.04%, 0.045%, 0.05%, 0.055%, 0.06%, 0.065%, 0.07%, 0.075%, 0.08%, 0.085%, 0.09%, 0.095%, 0.1%, 0.105%, 0.11%, 0.115%, 0.12%, 0.125%, 0.13%, 0.135%, 0.14%, 0.145%, 0.15%, 0.155%, 0.16%, 0.165%, 0.17%, 0.175%, 0.18%, 0.185%, 0.19%, 0.195%, 0.20%, 0.205%, 0.21%, 0.215%, 0.22%, 0.225%, 0.23%, 0.235%, 0.24%, 0.245%, or 0.25% Cr. All expressed in wt. %.

In certain examples, the alloy can include manganese (Mn) in an amount from about 0.05% to about 0.2% (e.g., from 0.05% to 0.18% or from 0.1% to 0.18%) based on the total weight of the alloy. For example, the alloy can include 0.05%, 0.051%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, 0.07%, 0.071%, 0.072%, 0.073%, 0.074%, 0.075%, 0.076%, 0.077%, 0.078%, 0.079%, 0.08%, 0.081%, 0.082%, 0.083%, 0.084%, 0.085%, 0.086%, 0.087%, 0.088%, 0.089%, 0.09%, 0.091%, 0.092%, 0.093%, 0.094%, 0.095%, 0.096%, 0.097%, 0.098%, 0.099%, 0.1%, 0.11%, 0.12%, 0.13%, 0.14%, 0.15%, 0.16%, 0.17%, 0.18%, 0.19%, or 0.2% Mn. All expressed in wt. %. In certain aspects, the Mn content is selected to minimize coarsening of constituent particles.

In certain aspects, some Cr is used to replace Mn in forming dispersoids. Replacing Mn with Cr can advantageously form dispersoids. In certain aspects, the alloy has a Cr/Mn weight ratio of about 0.15 to 0.6. For example, the Cr/Mn ratio may be 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, 0.50, 0.51, 0.52, 0.53, 0.54, 0.55, 0.56, 0.57, 0.58, 0.59, or 0.60. In certain aspects, the Cr/Mn ratio promotes appropriate dispersoids, leading to improved formability, strengthening, and corrosion resistance.

In certain aspects, the alloy also includes iron (Fe) in an amount from about 0.15% to about 0.3% (e.g., from 0.15% to 0.25%, from 0.18% to 0.25%, from 0.2% to 0.21%, or from 0.15% to 0.22%) based on the total weight of the alloy. For example, the alloy can include 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, or 0.30% Fe. All expressed in wt. %. In certain aspects, the Fe content reduces the forming of coarse constituent particles.

In certain aspects, the alloy includes zirconium (Zr) in an amount up to about 0.2% (e.g., from 0% to 0.2%, from 0.01% to 0.2%, from 0.01% to 0.15%, from 0.01% to 0.1%, or from 0.02% to 0.09%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Zr. In certain aspects, Zr is not present in the alloy (i.e., 0%). All expressed in wt. %.

In certain aspects, the alloy includes scandium (Sc) in an amount up to about 0.2% (e.g., from 0% to 0.2%, from 0.01% to 0.2%, from 0.05% to 0.15%, or from 0.05% to 0.2%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Sc. In certain examples, Sc is not present in the alloy (i.e., 0%). All expressed in wt. %.

In certain aspects, Sc and/or Zr are added to the above-described compositions to form $Al_3Sc$, $(Al,Si)_3Sc$, $(Al,Si)_3Zr$ and/or $Al_3Zr$ dispersoids.

In certain aspects, the alloy includes tin (Sn) in an amount up to about 0.25% (e.g., from 0% to 0.25%, from 0% to 0.2%, from 0% to 0.05%, from 0.01% to 0.15%, or from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, or 0.25%. In certain aspects, Sn is not present in the alloy (i.e., 0%). All expressed in wt. %.

In certain aspects, the alloy described herein includes zinc (Zn) in an amount up to about 0.9% (e.g., from 0.001% to 0.9%, from 0.004% to 0.9%, from 0.03% to 0.9%, from 0.06% to 0.1%, or from 0.001% to 0.09%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, or 0.9% Zn. All expressed in wt. %.

In certain aspects, the alloy includes titanium (Ti) in an amount up to about 0.1% (e.g., from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.07%, 0.08%, 0.09%, or 0.1% Ti. All expressed in wt. %. In certain aspects, Ti is used as a grain-refiner agent.

In certain aspects, the alloy includes nickel (Ni) in an amount up to about 0.07% (e.g., from 0% to 0.05%, from 0.01% to 0.07%, from 0.03% to 0.034%, from 0.02% to 0.03%, from 0.034 to 0.054%, from 0.03 to 0.06%, or from 0.001% to 0.06%) based on the total weight of the alloy. For example, the alloy can include 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%,0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, or 0.07% Ni. In certain aspects, Ni is not present in the alloy (i.e., 0%). All expressed in wt. %.

Optionally, the alloy compositions can further include other minor elements, sometimes referred to as impurities, in amounts of about 0.05% or below, 0.04% or below, 0.03% or below, 0.02% or below, or 0.01% or below each. These impurities may include, but are not limited to, V, Ga, Ca, Hf, Sr, or combinations thereof. Accordingly, V, Ga, Ca, Hf, or Sr may be present in an alloy in amounts of 0.05% or below, 0.04% or below, 0.03% or below, 0.02% or below, or 0.01% or below. In certain aspects, the sum of all impurities does not exceed 0.15% (e.g., 0.1%). All expressed in wt. %. In certain aspects, the remaining percentage of the alloy is aluminum.

Optionally, a non-limiting example of an alloy can have the following elemental composition as provided in Table 7:

TABLE 7

| Element | Weight Percentage (wt. %) |
|---|---|
| Cu | 0.5-2.0 |
| Si | 0.5-1.5 |
| Mg | 0.5-1.5 |
| Cr | 0.001-0.25 |
| Mn | 0.005-0.40 |
| Fe | 0.1-0.3 |
| Zr | 0-0.2 |
| Sc | 0-0.2 |
| Sn | 0-0.25 |
| Zn | 0-4.0 |
| Ti | 0-0.15 |
| Ni | 0-0.1 |
| Others | 0-0.05 (each) |
| | 0-0.15 (total) |
| Al | |

Another non-limiting example of such an alloy has the following elemental composition as provided in Table 8:

TABLE 8

| Element | Weight Percentage (wt. %) |
|---|---|
| Cu | 0.5-2.0 |
| Si | 0.5-1.35 |
| Mg | 0.6-1.5 |
| Cr | 0.001-0.18 |
| Mn | 0.005-0.4 |
| Fe | 0.1-0.3 |
| Zr | 0-0.2 |
| Sc | 0-0.2 |
| Sn | 0-0.25 |
| Zn | 0-0.9 |
| Ti | 0-0.15 |
| Ni | 0-0.07 |
| Others | 0-0.05 (each) |
| | 0-0.15 (total) |
| Al | |

Another non-limiting example of such an alloy has the following elemental composition as provided in Table 9:

TABLE 9

| Element | Weight Percentage (wt. %) |
|---|---|
| Cu | 0.6-1.0 |
| Si | 0.6-1.35 |
| Mg | 0.8-1.3 |
| Cr | 0.03-0.15 |
| Mn | 0.05-0.4 |
| Fe | 0.1-0.3 |
| Zr | 0-0.2 |
| Sn | 0-0.25 |
| Zn | 0-3.5 |
| Ti | 0-0.15 |
| Ni | 0-0.05 |
| Sc | 0-0.2 |
| Others | 0-0.05 (each) |
| | 0-0.15 (total) |
| Al | |

Another non-limiting example of such an alloy has the following elemental composition as provided in Table 10:

TABLE 10

| Element | Weight Percentage (wt. %) |
|---|---|
| Cu | 0.6-0.95 |
| Si | 0.7-1.25 |
| Mg | 0.8-1.25 |
| Cr | 0.03-0.1 |
| Mn | 0.05-0.35 |
| Fe | 0.15-0.25 |
| Zr | 0-0.2 |
| Sn | 0-0.25 |
| Zn | 0.5-3.5 |
| Ti | 0-0.15 |
| Ni | 0-0.05 |
| Sc | 0-0.2 |
| Others | 0-0.05 (each)<br>0-0.15 (total) |
| Al | |

Another non-limiting example of such an alloy has the following elemental composition as provided in Table 11:

TABLE 11

| Element | Weight Percentage (wt. %) |
|---|---|
| Cu | 0.6-2.0 |
| Si | 0.55-1.35 |
| Mg | 0.6-1.35 |
| Cr | 0.001-0.18 |
| Mn | 0.005-0.40 |
| Fe | 0.1-0.3 |
| Zr | 0-0.05 |
| Sc | 0-0.05 |
| Sn | 0-0.05 |
| Zn | 0-4.0 |
| Ti | 0.005-0.25 |
| Ni | 0-0.07 |
| Others | 0-0.05 (each)<br>0-0.15 (total) |
| Al | |

Another non-limiting example of such an alloy has the following elemental composition as provided in Table 12:

TABLE 12

| Element | Weight Percentage (wt. %) |
|---|---|
| Cu | 0.65-0.95 |
| Si | 0.6-1.35 |
| Mg | 0.65-1.28 |
| Cr | 0.005-0.12 |
| Mn | 0.07-0.36 |
| Fe | 0.2-0.26 |
| Zr | 0-0.05 |
| Sc | 0-0.05 |
| Sn | 0-0.05 |
| Zn | 0.5-3.1 |
| Ti | 0.08-0.14 |
| Ni | 0.02-0.06 |
| Others | 0-0.05 (each)<br>0-0.15 (total) |
| Al | |

Another non-limiting example of such an alloy has the following elemental composition as provided in Table 13:

TABLE 13

| Element | Weight Percentage (wt. %) |
|---|---|
| Cu | 0.6-0.9 |
| Si | 0.7-1.1 |
| Mg | 0.8-1.5 |
| Cr | 0.06-0.15 |
| Mn | 0.05-0.3 |
| Fe | 0.1-0.3 |
| Zr | 0-0.2 |
| Sc | 0-0.2 |
| Sn | 0-0.25 |
| Zn | 0-0.2 |
| Ti | 0-0.15 |
| Ni | 0-0.07 |
| Others | 0-0.05 (each)<br>0-0.15 (total) |
| Al | |

Another non-limiting example of such an alloy has the following elemental composition as provided in Table 14:

TABLE 14

| Element | Weight Percentage (wt. %) |
|---|---|
| Cu | 0.8-1.95 |
| Si | 0.6-0.9 |
| Mg | 0.8-1.2 |
| Cr | 0.06-0.18 |
| Mn | 0.005-0.35 |
| Fe | 0.13-0.25 |
| Zr | 0-0.05 |
| Sc | 0-0.05 |
| Sn | 0-0.05 |
| Zn | 0.5-3.1 |
| Ti | 0.01-0.14 |
| Ni | 0-0.05 |
| Others | 0-0.05 (each)<br>0-0.15 (total) |
| Al | |

Another non-limiting example of such an alloy has the following elemental composition as provided in Table 15:

TABLE 15

| Element | Weight Percentage (wt. %) |
|---|---|
| Cu | 0.8-1.8 |
| Si | 0.6-0.8 |
| Mg | 0.8-1.1 |
| Cr | 0.08-0.15 |
| Mn | 0.01-0.34 |
| Fe | 0.15-0.25 |
| Zr | 0-0.05 |
| Sc | 0-0.05 |
| Sn | 0-0.05 |
| Zn | 0.5-3.1 |
| Ti | 0.01-0.14 |
| Ni | 0-0.05 |
| Others | 0-0.05 (each)<br>0-0.15 (total) |
| Al | |

In certain aspects, the alloy includes copper (Cu) in an amount from about 0.5% to about 3.0% (e.g., from about 0.5% to about 2.0%, from 0.6 to 2.0%, from 0.7 to 0.9%, from 1.35% to 1.95%, from 0.84% to 0.94%, from 1.6% to 1.8%, from 0.78% to 0.92%, from 0.75% to 0.85%, or from 0.65% to 0.75%) based on the total weight of the alloy. For example, the alloy can include 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, 1.5%, 1.51%, 1.52%, 1.53%, 1.54%, 1.55%, 1.56%, 1.57%, 1.58%, 1.59%, 1.6%, 1.61%, 1.62%, 1.63%, 1.64%, 1.65%, 1.66%, 1.67%, 1.68%, 1.69%, 1.7%, 1.71%, 1.72%, 1.73%, 1.74%, 1.75%, 1.76%, 1.77%, 1.78%, 1.79%, 1.8%, 1.81%, 1.82%, 1.83%, 1.84%, 1.85%, 1.86%, 1.87%, 1.88%, 1.89%, 1.9%, 1.91%, 1.92%, 1.93%, 1.94%, 1.95%, 1.96%, 1.97%, 1.98%, 1.99%, or 2.0% Cu. All expressed in wt. %.

In certain aspects, the alloy includes silicon (Si) in an amount from about 0.5% to about 1.5% (e.g., from 0.5% to 1.4%, from 0.55% to 1.35%, from 0.6% to 1.24%, from 1.0% to 1.3%, or from 1.03% to 1.24%) based on the total weight of the alloy. For example, the alloy can include 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, or 1.5% Si. All expressed in wt. %.

In certain aspects, the alloy includes magnesium (Mg) in an amount from about 0.5% to about 3.0% (e.g., from about 0.5% to about 1.5%, from 0.6% to 1.35%, from 0.65% to 1.2%, from 0.8% to 1.2%, or from 0.9% to 1.1%) based on the total weight of the alloy. For example, the alloy can include 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, or 1.5% Mg. All expressed in wt. %.

In certain aspects, the alloy includes chromium (Cr) in an amount from about 0.001% to about 0.25% (e.g., from 0.001% to 0.15%, from 0.001% to 0.13%, from 0.005% to 0.12%, from 0.02% to 0.04%, from 0.08% to 0.15%, from 0.03% to 0.045%, from 0.01% to 0.06%, from 0.035% to 0.045%, from 0.004% to 0.08%, from 0.06% to 0.13%, from 0.06% to 0.18%, from 0.1% to 0.13%, or from 0.11% to 0.12%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.02%, 0.025%, 0.03%, 0.035%, 0.04%, 0.045%, 0.05%, 0.055%, 0.06%, 0.065%, 0.07%, 0.075%, 0.08%, 0.085%, 0.09%, 0.095%, 0.1%, 0.105%, 0.11%, 0.115%, 0.12%, 0.125%, 0.13%, 0.135%, 0.14%, 0.145%, 0.15%, 0.155%, 0.16%, 0.165%, 0.17%, 0.175%, 0.18%, 0.185%, 0.19%, 0.195%, 0.20%, 0.205%, 0.21%, 0.215%, 0.22%, 0.225%, 0.23%, 0.235%, 0.24%, 0.245%, or 0.25% Cr. All expressed in wt. %.

In certain aspects, the alloy can include manganese (Mn) in an amount from about 0.005% to about 0.4% (e.g., from 0.005% to 0.34%, from 0.25% to 0.35%, from 0.11% to 0.19%, from 0.08% to 0.12%, from 0.12% to 0.18%, from 0.09% to 0.31%, from 0.005% to 0.05%, and from 0.01 to 0.03%) based on the total weight of the alloy. For example, the alloy can include 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, 0.07%, 0.071%, 0.072%, 0.073%, 0.074%, 0.075%, 0.076%, 0.077%, 0.078%, 0.079%, 0.08%, 0.081%, 0.082%, 0.083%, 0.084%, 0.085%, 0.086%, 0.087%, 0.088%, 0.089%, 0.09%, 0.091%, 0.092%, 0.093%, 0.094%, 0.095%, 0.096%, 0.097%, 0.098%, 0.099%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, or 0.4% Mn. All expressed in wt. %.

In certain aspects, the alloy includes iron (Fe) in an amount from about 0.1% to about 0.3% (e.g., from 0.15% to 0.25%, from 0.14% to 0.26%, from 0.13% to 0.27%, from 0.12% to 0.28%, or from 0.14% to 0.28%) based on the total weight of the alloy. For example, the alloy can include 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, or 0.3% Fe. All expressed in wt. %.

In certain aspects, the alloy includes zirconium (Zr) in an amount up to about 0.2% (e.g., from 0% to 0.2%, from 0.01% to 0.2%, from 0.01% to 0.15%, from 0.01% to 0.1%, or from 0.02% to 0.09%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Zr. In certain cases, Zr is not present in the alloy (i.e., 0%). All expressed in wt. %.

In certain aspects, the alloy includes scandium (Sc) in an amount up to about 0.2% (e.g., from 0% to 0.2%, from 0.01% to 0.2%, from 0.05% to 0.15%, or from 0.05% to 0.2%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Sc. In certain cases, Sc is not present in the alloy (i.e., 0%). All expressed in wt. %.

In certain aspects, the alloy includes zinc (Zn) in an amount up to about 10%, (e.g., up to about 8%, up to about 6%, up to about 4%, from 0.001% to 0.09%, from 0.2% to 10.0%, from 0.5% to 8.0%, from 2.0 to 6.0%, from 0.4% to 3.0%, from 0.03% to 0.3%, from 0% to 1.0%, from 1.0% to 2.5%, or from 0.06% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, 0.25%, 0.26%, 0.27%, 0.28%, 0.29%, 0.3%, 0.31%, 0.32%, 0.33%, 0.34%, 0.35%, 0.36%, 0.37%, 0.38%, 0.39%, 0.4%, 0.41%, 0.42%, 0.43%, 0.44%, 0.45%, 0.46%, 0.47%, 0.48%, 0.49%, 0.5%, 0.51%, 0.52%, 0.53%, 0.54%, 0.55%, 0.56%, 0.57%, 0.58%, 0.59%, 0.6%, 0.61%, 0.62%, 0.63%, 0.64%, 0.65%, 0.66%, 0.67%, 0.68%, 0.69%, 0.7%, 0.71%, 0.72%, 0.73%, 0.74%, 0.75%, 0.76%, 0.77%, 0.78%, 0.79%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.11%, 1.12%, 1.13%, 1.14%, 1.15%, 1.16%, 1.17%, 1.18%, 1.19%, 1.2%, 1.21%, 1.22%, 1.23%, 1.24%, 1.25%, 1.26%, 1.27%, 1.28%, 1.29%, 1.3%, 1.31%, 1.32%, 1.33%, 1.34%, 1.35%, 1.36%, 1.37%, 1.38%, 1.39%, 1.4%, 1.41%, 1.42%, 1.43%, 1.44%, 1.45%, 1.46%, 1.47%, 1.48%, 1.49%, 1.5%, 1.51%, 1.52%, 1.53%, 1.54%, 1.55%, 1.56%, 1.57%, 1.58%, 1.59%, 1.6%, 1.61%, 1.62%, 1.63%, 1.64%, 1.65%, 1.66%, 1.67%, 1.68%, 1.69%, 1.7%, 1.71%, 1.72%, 1.73%, 1.74%, 1.75%, 1.76%, 1.77%, 1.78%, 1.79%, 1.8%, 1.81%, 1.82%, 1.83%, 1.84%, 1.85%, 1.86%, 1.87%, 1.88%, 1.89%, 1.9%, 1.91%, 1.92%, 1.93%, 1.94%, 1.95%, 1.96%, 1.97%, 1.98%, 1.99%, 2.0%, 2.01%, 2.02%, 2.03%, 2.04%, 2.05%, 2.06%, 2.07%, 2.08%, 2.09%, 2.1%, 2.11%, 2.12%, 2.13%, 2.14%, 2.15%, 2.16%, 2.17%, 2.18%, 2.19%, 2.2%, 2.21%, 2.22%, 2.23%, 2.24%, 2.25%, 2.26%, 2.27%, 2.28%, 2.29%, 2.3%, 2.31%, 2.32%, 2.33%, 2.34%, 2.35%, 2.36%, 2.37%, 2.38%, 2.39%, 2.4%, 2.41%, 2.42%, 2.43%, 2.44%, 2.45%, 2.46%, 2.47%, 2.48%, 2.49%, 2.5%, 2.51%, 2.52%, 2.53%, 2.54%, 2.55%, 2.56%, 2.57%, 2.58%, 2.59%, 2.6%, 2.61%, 2.62%, 2.63%, 2.64%, 2.65%, 2.66%, 2.67%, 2.68%, 2.69%, 2.7%, 2.71%, 2.72%, 2.73%, 2.74%, 2.75%, 2.76%, 2.77%, 2.78%, 2.79%, 2.8%, 2.81%, 2.82%, 2.83%, 2.84%, 2.85%, 2.86%, 2.87%, 2.88%, 2.89%, 2.9%, 2.91%, 2.92%, 2.93%, 2.94%, 2.95%, 2.96%, 2.97%, 2.98%, 2.99%, 3.0%, 3.01%, 3.02%, 3.03%, 3.04%, 3.05%, 3.06%, 3.07%, 3.08%, 3.09%, 3.1%, 3.11%, 3.12%, 3.13%, 3.14%, 3.15%, 3.16%, 3.17%, 3.18%, 3.19%, 3.2%, 3.21%, 3.22%, 3.23%, 3.24%, 3.25%, 3.26%, 3.27%, 3.28%, 3.29%, 3.3%, 3.31%, 3.32%, 3.33%, 3.34%, 3.35%, 3.36%, 3.37%, 3.38%, 3.39%, 3.4%, 3.41%, 3.42%, 3.43%, 3.44%, 3.45%, 3.46%, 3.47%, 3.48%, 3.49%, 3.5%, 3.51%, 3.52%, 3.53%, 3.54%, 3.55%, 3.56%, 3.57%, 3.58%, 3.59%, 3.6%, 3.61%, 3.62%, 3.63%, 3.64%, 3.65%, 3.66%, 3.67%, 3.68%, 3.69%, 3.7%, 3.71%, 3.72%, 3.73%, 3.74%, 3.75%, 3.76%, 3.77%, 3.78%, 3.79%, 3.8%, 3.81%, 3.82%, 3.83%, 3.84%, 3.85%, 3.86%, 3.87%, 3.88%, 3.89%, 3.9%, 3.91%, 3.92%, 3.93%, 3.94%, 3.95%, 3.96%, 3.97%, 3.98%, 3.99%, or 4.0% Zn. In certain cases, Zn is not present in the alloy (i.e., 0%). All expressed in wt. %.

In certain aspects, the alloy includes tin (Sn) in an amount up to about 0.25% (e.g., from 0% to 0.25%, from 0% to 0.2%, from 0% to 0.05%, from 0.01% to 0.15%, or from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, 0.2%, 0.21%, 0.22%, 0.23%, 0.24%, or 0.25%. In certain cases, Sn is not present in the alloy (i.e., 0%). All expressed in wt. %.

In certain aspects, the alloy includes titanium (Ti) in an amount up to about 0.15% (e.g., from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.07%, 0.08%, 0.09%, 0.1%, 0.11%, 0.12%, 0.13%, 0.14%, or 0.15% Ti. In certain cases, Ti is not present in the alloy (i.e., 0%). All expressed in wt. %.

In certain aspects, the alloy includes nickel (Ni) in an amount up to about 0.1% (e.g., from 0.01% to 0.1%) based on the total weight of the alloy. For example, the alloy can include 0.001%, 0.002%, 0.003%, 0.004%, 0.005%, 0.006%, 0.007%, 0.008%, 0.009%, 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%, 0.041%, 0.042%, 0.043%, 0.044%, 0.045%, 0.046%, 0.047%, 0.048%, 0.049%, 0.05%, 0.051%, 0.052%, 0.053%, 0.054%, 0.055%, 0.056%, 0.057%, 0.058%, 0.059%, 0.06%, 0.07%, 0.08%, 0.09%, or 0.1% Ni. In certain aspects, Ni is not present in the alloy (i.e., 0%). All expressed in wt. %.

Optionally, the alloy compositions described herein can further include other minor elements, sometimes referred to as impurities, in amounts of about 0.05% or below, 0.04% or below, 0.03% or below, 0.02% or below, or 0.01% or below each. These impurities may include, but are not limited to, V, Ga, Ca, Hf, Sr, or combinations thereof. Accordingly, V, Ga, Ca, Hf, or Sr may be present in an alloy in amounts of 0.05% or below, 0.04% or below, 0.03% or below, 0.02% or below, or 0.01% or below. In certain examples, the sum of all impurities does not exceed about 0.15% (e.g., 0.1%). All expressed in wt. %. In certain examples, the remaining percentage of the alloy is aluminum.

Examples of suitable 6xxx series aluminum alloy compositions for use in the aluminum alloy products described herein include the compositions of, for example, AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, and AA6092.

Examples of suitable 7xxx series aluminum alloy compositions for use in the aluminum alloy products described herein include the compositions of, for example, AA7003, AA7004, AA7204, AA7005, AA7108, AA7108A, AA7009, AA7010, AA7012, AA7014, AA7015, AA7016, AA7116, AA7017, AA7018, AA7019, AA7019A, AA7020, AA7021, AA7022, AA7122, AA7023, AA7024, AA7025, AA7026, AA7028, AA7029, AA7129, AA7229, AA7030, AA7031, AA7032, AA7033, AA7034, AA7035, AA7035A, AA7036, AA7136, AA7037, AA7039, AA7040, AA7140, AA7041, AA7042, AA7046, AA7046A, AA7047, AA7049, AA7049A, AA7149, AA7249, AA7349, AA7449, AA7050, AA7050A, AA7150, AA7055, AA7155, AA7255, AA7056, AA7060, AA7064, AA7065, AA7068, AA7168, AA7072, AA7075, AA7175, AA7475, AA7076, AA7178, AA7278, AA7278A, AA7081, AA7181, AA7085, AA7185, AA7090, AA7093, AA7095, AA7099, and AA7199.

Exemplary Alloys

An exemplary alloy includes from 0.64% to 0.74% Si, 0.20% to 0.26% Fe, 0.75% to 0.91% Cu, 0.10% to 0.15% Mn, 0.83% to 0.96% Mg, 0.11% to 0.19% Cr, 0.10% Zn, up to 0.03% Ti, and up to 0.15% total impurities, with the remainder Al.

An exemplary alloy includes 0.72% Si, 0.14% Fe, 0.2% Cu, 0.13% Mn, 1.0% Mg, 0.09% Cr, and up to 0.15% total impurities, with the remainder Al.

An exemplary alloy includes 00.63% Si, 0.19% Fe, 0.73% Cu, 0.13% Mn, 0.77% Mg, 0.005% Cr, and up to 0.15% total impurities, with the remainder Al.

An exemplary alloy includes 0.74% Si, 0.20% Fe, 0.75% Cu, up to 0.15% Mn, 0.83% Mg, less than 0.19% Cr, and up to 0.15% total impurities, with the remainder Al.

An exemplary alloy includes 1.03% Si, 0.22% Fe, 0.66% Cu, 0.14% Mn, 1.07% Mg, 0.025 Ti, 0.06% Cr, and up to 0.15% total impurities, with the remainder Al.

Another exemplary alloy includes 1.24% Si, 0.22% Fe, 0.81% Cu, 0.11% Mn, 1.08% Mg, 0.024% Ti, 0.073% Cr, and up to 0.15% total impurities, with the remainder Al.

Another exemplary alloy includes 1.19% Si, 0.16% Fe, 0.66% Cu, 0.17% Mn, 1.16% Mg, 0.02% Ti, 0.03% Cr, and up to 0.15% total impurities, with the remainder Al.

Another exemplary alloy includes 0.97% Si, 0.18% Fe, 0.80% Cu, 0.19% Mn, 1.11% Mg, 0.02% Ti, 0.03% Cr, and up to 0.15% total impurities, with the remainder Al.

Another exemplary alloy includes 1.09% Si, 0.18% Fe, 0.61% Cu, 0.18% Mn, 1.20% Mg, 0.02% Ti, 0.03% Cr, and up to 0.15% total impurities, with the remainder Al.

Another exemplary alloy includes 0.76% Si, 0.22% Fe, 0.91% Cu, 0.32% Mn, 0.94% Mg, 0.12% Ti, 3.09% Zn, and up to 0.15% total impurities, with the remainder Al.

Another exemplary alloy includes 0.83% Si, 0.23% Fe, 0.78% Cu, 0.14% Mn, 0.92% Mg, 0.12 Cr, 0.03% Ti, 0.02% Zn, and up to 0.15% total impurities, with the remainder Al.

Another exemplary alloy includes 0.70% Si, 0.25% Fe, 0.91% Cu, 0.12% Mn, 0.88% Mg, 0.15% Cr, 0.013% Zn, and up to 0.15% total impurities, with the remainder Al.

Alloy Properties

In some non-limiting examples, the disclosed alloys have very high strength and good corrosion resistance compared to conventional 6xxx and 7xxx series aluminum alloys. In certain cases, the alloys also demonstrate very good anodized qualities.

In certain aspects, the aluminum alloys may have a yield service strength (strength on a vehicle) of at least about 450 MPa. In non-limiting examples, the in-service strength is at least about 455 MPa, at least about 460 MPa, at least about 465 MPa, at least about 470 MPa, at least about 475 MPa, at least about 480 MPa, at least about 485 MPa, at least about 490 MPa, at least about 495 MPa, at least about 500 MPa, at least about 505 MPa, at least about 510 MPa, at least about 515 MPa, at least about 520 MPa, at least about 525 MPa, at least about 530 MPa, at least about 535 MPa, at least about 540 MPa, at least about 545 MPa, at least about 550 MPa, at least about 555 MPa, at least about 560 MPa, or at least about 565 MPa. In some cases, the in-service strength is from about 450 MPa to about 565 MPa. For example, the in-service strength can be from about 450 MPa to about 565 MPa, from about 460 MPa to about 560 MPa, from about 475 MPa to about 560 MPa, or from about 500 MPa to about 560 MPa. In some cases, the in-service strength can be at least 550 Mpa, (e.g., from 500 Mpa to about 700 MPa) in the L direction, the T direction, or both the L and T directions.

In certain aspects, the alloy provides a uniform elongation of greater than or equal to 5%. In certain aspects, the alloy provides a uniform elongation of greater than or equal to 6% or greater than or equal to 7%.

In certain aspects, the alloy may have a corrosion resistance that provides an intergranular corrosion (IGC) attack depth of 200 μm or less under the ASTM G110 standard. In certain cases, the IGC corrosion attack depth is 190 μm or less, 180 μm or less, 170 μm or less, 160 μm or less, or even 150 μm or less. In some further examples, the alloy may have a corrosion resistance that provides an IGC attack depth of 300 μm or less for thicker gauge shates and 350 um or less for thinner gauge sheets under the ISO 11846 standard. In certain cases, the IGC attack depth is 290 μm or less, 280 μm or less, 270 μm or less, 260 μm or less, 250 μm or less, 240 μm or less, 230 μm or less, 220 μm or less, 210 μm or less, 200 μm or less, 190 μm or less, 180 μm or less, 170 μm or less, 160 μm or less, or even 150 μm or less for alloy shates. In certain cases, the IGC attack depth is 340 μm or less, 330 μm or less, 320 μm or less, 310 μm or less, 300 μm or less, 290 μm or less, 280 μm or less, 270 μm or less, 260 μm or less, 250 μm or less, 240 μm or less, 230 μm or less, 220 μm or less, 210 μm or less, 200 μm or less, 190 μm or less, 180 μm or less, 170 μm or less, 160 μm or less, or even 150 μm or less for alloy products.

The mechanical properties of the aluminum alloys disclosed herein may be controlled by various ageing conditions depending on the desired use. As one example, the alloy can be produced (or provided) in the T8 temper. Plates, shates (i.e., sheet plates) or sheets, which refer to plates, shates, or sheets that are solution heat-treated and under-aged, can be provided. These plates, shates, and sheets can optionally be subjected to additional re-ageing treatment(s) to meet strength requirements upon receipt. For example, plates, shates, and sheets can be delivered in the desired tempers, such as the T8 temper, by subjecting the alloy material to the appropriate ageing treatment as described herein or otherwise known to those of skill in the art. As used herein, the term "under-aged" refers to a process where the alloy is heated to increase its strength but at least one of the heating and time for heating is controlled so that the alloy does not reach its peak strength. Thus, the alloy's strength, after under-ageing, is between a T4 temper and T6 temper strength, for example.

Methods of Preparing the Plates and Shates

The 6xxx and 7xxx series aluminum alloys described herein can be cast into, for example but not limited to, ingots, billets, slabs, plates, shates or sheets, using any suitable casting method. As a few non-limiting examples, the casting process can include a direct chill (DC) casting process or a continuous casting (CC) process. The CC process may include, but is not limited to, the use of twin belt casters, twin roll casters, or block casters. In addition, the 6xxx and 7xxx series aluminum alloys described herein may be formed into extrusions using any suitable method known to those skilled in the art. The alloy, as a cast ingot, billet, slab, plate, shate, sheet, or extrusion, can then be subjected to further processing steps.

FIG. 1 shows a schematic of one exemplary process for producing the disclosed alloys including solution treatment (ST), under-ageing (UA), cold reduction, and re-ageing (RA) to form the final temper. In some examples, the 6xxx or 7xxx series aluminum alloy is prepared by solutionizing the alloy at a temperature between about 450° C. and about 600° C. (e.g., about 510° C. and about 590° C.). The solutionizing is followed by quenching, pre-ageing, cold work (CW), and then thermal treatment (re-ageing). The percentage of post pre-ageing CW varies from at least about 5% to 80% for example, from 10% to 80%, 15% to 80%, 20% to 80%, 25% to 80%, 10% to 75%, 10% to 70%, 10% to 65%, 10% to 60%, 10% to 55%, or 10 to 50% CW. In some aspects, the CW is up to 50%, (e.g., about 45%). By first solutionizing and then pre-ageing and cold working followed by re-ageing, improved properties in terms of yield strength and ultimate tensile strength were obtained without sacrificing the total % elongation. The % CW is referred to in this context as the change in thickness due to cold rolling divided by the initial strip thickness prior to cold rolling. The % CW is calculated as follows: (gauge−initial gauge)/(initial gauge)*100). In another exemplary process, the 6xxx series aluminum alloy is prepared by solutionizing the alloy followed by thermal treatment (artificial ageing) without CW. Cold work is also referred to as cold reduction (CR) in this application.

In certain aspects, the 6xxx and 7xxx aluminum alloy products described herein can be produced using roll forming, warm forming, or cryogenic forming, for example.

In some examples, the following processing conditions were applied. The samples were homogenized at about 400° C. to about 600° C. (e.g., about 510° C.-about 580° C.) for about 0.5-about 100 hours followed by hot rolling. For example, the homogenization temperature can be 480° C., 525° C., 530° C., 535° C., 540° C., 545° C., 550° C., 555° C., 560° C., 565° C., 570° C., or 575° C. The homogenization time can be 1 hour, 1.5 hours, 2 hours, 2.5 hours, 3 hours, 3.5 hours, 4 hours, 4.5 hours, 5 hours, 5.5 hours, 6 hours, 6.5 hours, 7 hours, 7.5 hours, 8 hours, 8.5 hours, 9 hours, 9.5 hours, 10 hours, 10.5 hours, 11 hours, 11.5 hours, 12 hours, 12.5 hours, 13 hours, 13.5 hours, 14 hours, 14.5 hours, 15 hours, 15.5 hours, 16 hours, 16.5 hours, 17 hours, 17.5 hours, 18 hours, 18.5 hours, 19 hours, 19.5 hours, 20 hours, 20.5 hours, 21 hours, 21.5 hours, 22 hours, 22.5 hours, 23 hours, 23.5 hours, 24 hours, 24.5 hours, 25 hours, 25.5 hours, 26 hours, 26.5 hours, 27 hours, 27.5 hours, 28 hours, 28.5 hours, 29 hours, 29.5 hours, 30 hours, 30.5 hours, 31 hours, 31.5 hours, 32 hours, 32.5 hours, 33 hours, 33.5 hours, 34 hours, 34.5 hours, 35 hours, 35.5 hours, 36 hours, 36.5 hours, 37 hours, 37.5 hours, 38 hours, 38.5 hours, 39 hours, 39.5 hours, 40 hours, 40.5 hours, 41 hours, 41.5 hours, 42 hours, 42.5 hours, 43 hours, 43.5 hours, 44 hours, 44.5 hours, 45 hours, 45.5 hours, 46 hours, 46.5 hours, 47 hours, 47.5 hours, 48 hours, 48.5 hours, 49 hours, 49.5 hours, 50 hours, 50.5 hours, 51 hours, 51.5 hours, 52 hours, 52.5 hours, 53 hours, 53.5 hours, 54 hours, 54.5 hours, 55 hours, 55.5 hours, 56 hours, 56.5 hours, 57 hours, 57.5 hours, 58 hours, 58.5 hours, 59 hours, 59.5 hours, 60 hours, 60.5 hours, 61 hours, 61.5 hours, 62 hours, 62.5 hours, 63 hours, 63.5 hours, 64 hours, 64.5 hours, 65 hours, 65.5 hours, 66 hours, 66.5 hours, 67 hours, 67.5 hours, 68 hours, 68.5 hours, 69 hours, 69.5 hours, 70 hours, 70.5 hours, 71 hours, 71.5 hours, 72 hours, 72.5 hours, 73 hours, 73.5 hours, 74 hours, 74.5 hours, 75 hours, 75.5 hours, 76 hours, 76.5 hours, 77 hours, 77.5 hours, 78 hours, 78.5 hours, 79 hours, 79.5 hours, 80 hours, 80.5 hours, 81 hours, 81.5 hours, 82 hours, 82.5 hours, 83 hours, 83.5 hours, 84 hours, 84.5 hours, 85 hours, 85.5 hours, 86 hours, 86.5 hours, 87 hours, 87.5 hours, 88 hours, 88.5 hours, 89 hours, 89.5 hours, 90 hours, 90.5 hours, 91 hours, 91.5 hours, 92 hours, 92.5 hours, 93 hours, 93.5 hours, 94 hours, 94.5 hours, 95 hours, 95.5 hours, 96 hours, 96.5 hours, 97 hours, 97.5 hours, 98 hours, 98.5 hours, 99 hours, 99.5 hours, and/or 100 hours. The target laydown temperature was 420-480° C. For example, the laydown temperature can be 425° C., 430° C., 435° C., 440° C., 445° C., 450° C., 455° C., 460° C., 465° C., 470° C., or 475° C. The target laydown temperature indicates the temperature of the ingot, slab, billet, plate, shate, or sheet before hot rolling. The samples were hot rolled to a gauge of 3 mm-18 mm (e.g., 5 mm-18 mm). For example, the gauge can be 4 mm, 6 mm, 7 mm, 8 mm, 9 mm, 10 mm, 11 mm, 12 mm, 13 mm, 14 mm, 15 mm, 16 mm, or 17 mm. In some examples, the gauges are about 7 mm and 12 mm.

The hot rolling step can be performed using a single stand mill or a multi-stand mill, such as a hot reversing mill operation or a hot tandem mill operation. The target entry hot roll temperature may be about 250° C. to about 550° C. (e.g., about 450° C.-about 540° C.). The entry hot roll temperature can be 380° C., 450° C., 455° C., 460° C., 465° C., 470° C., 475° C., 480° C., 485° C., 490° C., 495° C., 500° C., 505° C., 510° C., 515° C., 520° C., 525° C., 530° C., 535° C., or 540° C. The target exit hot roll temperature may be 200-400° C. The exit hot roll temperature can be about 200° C., about 205° C., about 210° C., about 215° C., about 220° C., about 225° C., about 230° C., about 235° C., about 240° C., about 245° C., about 250° C., about 255° C., about 260° C., about 265° C., about 270° C., about 275° C., about 280° C., about 285° C., about 290° C., about 295° C., about 300° C., about 305° C., about 310° C., about 315° C., about 320° C., about 325° C., about 330° C., about 335° C., about 340° C., about 345° C., about 350° C., about 355° C., about 360° C., about 365° C., about 370° C., about 375° C., about 380° C., about 385° C., about 390° C., about 395° C., or about 400° C.

The samples were subsequently solution heat treated at about 450° C. about-590° C. (e.g., about 520° C.-about 590° C.) for 0 seconds to about 1 hour followed by immediate ice water quench to ambient temperature to ensure maximum saturation. The solution heat treatment temperature can be about 480° C., about 515° C., about 520° C., about 525° C., about 530° C., or about 535° C. It is estimated that the duration to reach ambient temperature will vary based on the material thickness and is estimated to be between 1.5-5 seconds on average. In some examples, the amount of time to reach ambient temperature can be 2 seconds, 2.5 seconds, 3 seconds, 3.5 seconds, 4 seconds, or 4.5 seconds. Ambient temperature may be about −10° C. to about 60° C. Ambient temperature may also be about 0° C., about 10° C., about 20° C., about 30° C., about 40° C., or about 50° C.

In some examples, a method of making an aluminum alloy product can include the following steps: casting, e.g., DC casting a 6xxx series aluminum alloy, rapidly heating the cast aluminum alloy to a temperature of about 510° C. to about 580° C.; maintaining the cast aluminum alloy at the temperature of about 510° C. to about 580° C. for about 0.5 to about 100 hours; hot rolling the cast aluminum alloy into the aluminum alloy product, the hot rolling having an entry temperature of about 450° C. to about 540° C. and an exit temperature of about 30° C. to about 400° C., the rolled aluminum alloy product having a first gauge from 5 to 12 mm; cold rolling the rolled aluminum alloy product to a first gauge of 2 to 4 mm; solution heat treating the rolled aluminum alloy product at a temperature of about 520° C. to about 590° C.; quenching the aluminum alloy product to ambient temperature; optionally pre-ageing the aluminum alloy product at about 60° C. to about 150° C.; cooling the (pre-aged) aluminum alloy product; under-ageing the pre-aged aluminum alloy product at a temperature of about 90° C. to about 200° C. for a time of about 1 to about 72 hours; cold rolling the under-aged aluminum alloy product to a final gauge of 1 to 3 mm with a cold reduction between the first and final gauge of 20 to 80%; and re-ageing the cold rolled aluminum alloy product at a temperature from about 90° C. to about 200° C. for a time of about 1 to about 72 hours. In some aspects, where a pre-ageing step is conducted, the under-ageing step may be replaced by a direct ageing treatment. This direct ageing treatment may be conducted by keeping the aluminum alloy product at the same pre-ageing temperature until the desired strength is reached. In some aspects, the desired strength is reached at 180° C. for a time of 10 hours.

In some examples, a method of making an aluminum alloy product can include the following steps: casting a 7xxx series aluminum alloy, rapidly heating the cast aluminum alloy to a temperature between about 400° C. and about 600° C., maintaining the cast aluminum alloy at the temperature between about 400° C. and about 600° C. for 0.5 to 100 hours, and hot rolling the cast aluminum alloy into an aluminum alloy product. The aluminum alloy product can have a thickness up to about 12 mm (e.g., from about 3 mm to about 12 mm) and a hot roll exit temperature between about 30° C. and about 400° C. Optionally cold rolling the rolled aluminum alloy product to a first gauge of 2 to 8 mm. The aluminum alloy product can optionally be subjected to heat treating at a temperature between about 460° C. to about 600° C. The heat treating may optionally be followed by quenching to ambient temperature. Further steps include: optionally pre-ageing the aluminum alloy product at about 60° C. to about 150° C.; cooling the (pre-aged) aluminum alloy product; under-ageing the pre-aged aluminum alloy product at a temperature of about 90° C. to about 200° C. for a time of about 1 to about 72 hours; cold rolling the under-aged aluminum alloy product to a final gauge of 1 to 3 mm with a cold reduction between the first and final gauge of 20 to 80%; and re-ageing the cold rolled aluminum alloy product at a temperature from about 90° C. to about 200° C. for a time of about 1 to about 72 hours. In some aspects, where a pre-ageing step is conducted, the under-ageing step may be replaced by a direct ageing treatment. This direct ageing treatment may be conducted by keeping the aluminum alloy product at the same pre-ageing temperature until the desired strength is reached. In some aspects, the desired strength is reached at 180° C. for a time of 10 hours.

In some examples, a method of making an aluminum alloy product can include the following steps: casting, e.g., DC casting a 6xxx series aluminum alloy; rapidly heating the cast aluminum alloy to a temperature of about 510° C. to about 580° C.; maintaining the cast aluminum alloy at the temperature of about 510° C. to about 580° C. for about 0.5 to about 100 hours; hot rolling the cast aluminum alloy into the aluminum alloy product and quenching, the hot rolling having an entry temperature of about 450° C. to about 540° C. and the quenching having an exit temperature of about 200° C. to about 300° C., the rolled aluminum alloy product having a first gauge from 5 to 12 mm; under-ageing the rolled aluminum alloy product at a temperature of about 140° C. to about 200° C. for a time of 1 to 72 hours; cold rolling the under-aged aluminum alloy product to a final gauge of 2 to 5 mm with a cold reduction between the first and final gauge of 20 to 80%; and re-ageing the cold rolled aluminum alloy product at a temperature from about 90° C. to about 200° C. for a time of about 1 to about 72 hours. In some aspects, the sample may be sent directly for heat treatment following quenching. In further aspects, the sample may be pre-aged as described herein.

In some examples, a method of making an aluminum alloy product can include the following steps: casting, e.g., continuously casting, a 6xxx series aluminum alloy, hot rolling the cast aluminum alloy into the aluminum alloy product, the hot rolling having an entry temperature of about 450° C. to about 540° C. and an exit temperature of about 30° C. to about 400° C., the rolled aluminum alloy product having a first gauge from 5 to 12 mm; optionally rapidly heating the rolled aluminum alloy product to a temperature of about 510° C. to about 580° C.; maintaining the rolled aluminum alloy at the temperature of about 510° C. to about 580° C. for about 0.5 to about 100 hours; cold rolling the rolled aluminum alloy product to a first gauge of 2 to 4 mm; solution heat treating the rolled aluminum alloy product at a temperature of about 510° C. to about 590° C.; quenching the aluminum alloy product to ambient temperature; optionally pre-ageing the aluminum alloy product at about 60° C. to about 150° C.; cooling the (pre-aged) aluminum alloy product; under-ageing the pre-aged aluminum alloy product at a temperature of about 90° C. to about 200° C. for a time of about 1 to about 72 hours; cold rolling the under-aged aluminum alloy product to a final gauge of 1 to 3 mm with a cold reduction between the first and final gauge of 20 to 80%; and re-ageing the cold rolled aluminum alloy product at a temperature from about 90° C. to about 200° C. for a time of about 1 to about 72 hours.

In some examples, a method of making an aluminum alloy product can include the following steps: casting, e.g., continuously casting, a 6xxx series aluminum alloy at a first speed, optionally subjecting the cast aluminum alloy to a post-casting quenching; optionally coiling the cast aluminum alloy into a coil; hot rolling the cast aluminum alloy into the aluminum alloy product at a second speed, the hot rolling having an entry temperature of 300° C. to 500° C. (e.g., about 450° C. to about 500° C.) and an exit temperature of no more than approximately 470° C., approximately 450° C., or approximately 430° C., the rolled aluminum alloy product having a first gauge from 5 to 12 mm; rapidly heating the rolled aluminum alloy product to a temperature of about 400° C. to about 590° C.; maintaining the rolled aluminum alloy at the temperature of about 400° C. to about 590° C. for up to about 30 minutes (e.g., 0 seconds, 60 seconds, 75 seconds, 90 seconds, 5 minutes, 10 minutes, 20 minutes, 25 minutes, or 30 minutes); quenching the aluminum alloy product to ambient temperature; under-ageing the aluminum alloy product at a temperature of about 140° C. to about 200° C. for a time of about 2 to about 72 hours; cold rolling the under-aged aluminum alloy product to a final gauge of 2 to 5 mm with a cold reduction between the first and final gauge of 20% to 80%; and re-ageing the cold rolled aluminum alloy product at a temperature from about 90° C. to about 200° C. for a time of about 1 hour to about 72 hours. In some aspects, the hot rolling temperature can be at or around 350° C., such as between 340° C. and 360° C., 330° C. and 370° C., 330° C. and 380° C., 300° C. and 400° C., or 250° C. and 400° C., although other ranges may be used. In some aspects, the aluminum alloy may be cast and subsequently coiled and may be subjected to a soak for about 1 minute to about 6 hours at a temperature from about 400° C. to about 580° C. The coil may then be uncoiled for hot rolling and subsequently recoiled. In further aspects, the sample may be pre-aged as described herein.

The under-ageing and re-ageing steps are described further herein. In some aspects, the under-ageing may occur at a temperature from about 90° C. to about 200° C. for about 1 to about 72 hours. The time interval between completion of solution heat treatment and quench, and initiation of under-ageing, may be below 72 hours to avoid effects of natural ageing. In some aspects, under-ageing can occur at temperatures ranging from about 90° C. to about 200° C., from about 155° C. to about 195° C. or about 160° C. to about 190° C. The under-ageing can occur for a duration from about 1 to about 72 hours, from 2 to 60 hours, from 5 to 48 hours, or from 5 hour to 36 hours. Following under-ageing, cold rolling may occur within 5 hours. In some aspects, cold rolling occurs from 1 minute to 5 hours after under-ageing, from 1 minute to 4 hours, from 1 minute to 3 hours, or from 1 minute to 2 hours.

Following under-ageing, as described above, samples were cold rolled, from an initial gauge of about 9.5, about 4.2 mm and about 3 mm to about 5 mm, about 2.5 mm and about 1 mm, respectively. Cold working percent may range from about 10 to about 70% CW, from about 12 to about 70%, from about 14 to about 70%, or from about 17 to about 67%. The % CW applied in some examples is 40% resulting in a final gauge of 7 mm (rolled from an initial thickness of 11.7 mm) and 3 mm (rolled from an initial thickness of 5 mm). This was followed by subsequent ageing at about 200° C. for about 1 to about 6 hours. In some cases, the subsequent ageing can occur at about 200° C. for about 0.5 to about 6 hours.

Following cold rolling, the samples may then be re-aged. Re-ageing generally occurs at a temperature that is lower than that of under-ageing. The re-ageing treatment can be performed at a temperature from about 90° C. to about 200° C. for a period of time of up to about 72 hours. For example, the re-ageing treatment can be performed at a temperature of about 90° C., about 95° C., about 100° C., about 105° C., about 110° C., about 115° C., about 120° C., about 125° C., about 130° C., about 135° C., about 140° C., about 145° C., about 150° C., about 155° C., about 160° C., about 165° C., about 170° C., about 175° C., about 180° C., about 185° C., about 190° C., about 195° C., or about 200° C. Optionally, the re-ageing treatment can be performed for about about 1 hour, about 2 hours, about 3 hours, about 4 hours, about 5 hours, about 10 hours, about 15 hours, about 20 hours, about 25 hours, about 30 hours, about 36 hours, about 42 hours, about 48 hours, about 60 hours, or about 72 hours.

In further aspects, the plate, shate or sheet can optionally undergo a pre-ageing treatment by reheating the plate, shate, or sheet before under-ageing. The pre-ageing treatment can be performed at a temperature of from about 50° C. to about 150° C. for a period of time of up to about 6 hours. For example, the pre-ageing treatment can be performed at a temperature of about 50° C., about 55° C., about 60° C., about 65° C., about 70° C., about 75° C., about 80° C., about 85° C., about 90° C., about 95° C., about 100° C., about 105° C., about 110° C., about 115° C., about 120° C., about 125° C., about 130° C., about 135° C., about 140° C., about 145° C., or about 150° C. Optionally, the pre-ageing treatment can be performed for about 30 minutes, about 1 hour, about 2 hours, about 3 hours, about 4 hours, about 5 hours, or about 6 hours. The pre-ageing treatment can be carried out by passing the plate, shate, or sheet through a heating device, such as a device that emits radiant heat, convective heat, induction heat, infrared heat, or the like. The pre-ageing treatment is carried out at a lower temperature than the subsequent under-ageing step described above. Pre-ageing may be helpful in lowering the impact on strength caused by increased waiting times between solution heat treatment and further cold rolling.

Following pre-ageing, the sample need not be under-aged within 24 hours and can instead wait for up to 3 days, up to 1 week, up to 2 weeks, or even longer before under-ageing.

The under-ageing may occur at a temperature from about 90° C. to about 200° C. (e.g., from about 140° C. to about 200° C.) for about 0.1 to about 72 hours. In some aspects, under-ageing can occur at temperatures ranging from about 95° C. to about 200° C., from about 140° C. to about 195° C., from about 145° C. to about 195° C. or about 150° C. to about 190° C. The under-ageing can occur for a duration from about 1 to about 72 hours, from about 4 to about 72 hours, from about 4 to about 24 hours, or from about 5 hour to about 15 hours. Following under-ageing, cold rolling may occur within about 5 hours. In some aspects, cold rolling occurs from about 1 minute to about 5 hours after under-ageing, from about 1 minute to about 4 hours, from about 1 minute to about 3 hours, or from about 1 minute to about 2 hours. Without being bound by theory, it is believed that under-ageing results in a stable microstructure, allowing for increased time between under-ageing and cold rolling.

Following under-ageing, the samples were cold rolled from initial gauges of about 9.5 mm, about 4.2 mm, and about 3 mm to about 5 mm, about 2.5 mm, and about 1 mm, respectively. Cold working percent may range from about 10% to about 70% CW, from about 12% to about 70%, from about 14% to about 70%, or from about 17% to about 67%. The % CW applied in some examples is about 40% resulting in a final gauge of about 7 mm (rolled from an initial thickness of about 11.7 mm) and about 3 mm (rolled from an initial thickness of about 5 mm). This was followed by subsequent ageing at about 200° C. for about 1 to about 6 hours. In some cases, the subsequent ageing can occur at about 200° C. for about 0.5 to about 6 hours.

Following cold rolling, the samples may then be re-aged. Re-ageing generally occurs at a temperature that is lower than that of under-ageing. The re-ageing treatment can be performed at a temperature of from about 50° C. to about 150° C. for a period of time of up to about 72 hours. For example, the re-ageing treatment can be performed at a temperature of about 50° C., about 55° C., about 60° C., about 65° C., about 70° C., about 75° C., about 80° C., about 85° C., about 90° C., about 95° C., about 100° C., about 105° C., about 110° C., about 115° C., about 120° C., about 125° C., about 130° C., about 135° C., about 140° C., about 145° C., or about 150° C. Optionally, the re-ageing treatment can be performed for about 30 minutes, about 1 hour, about 2 hours, about 3 hours, about 4 hours, about 5 hours, about 10 hours, about 15 hours, about 20 hours, about 25 hours, about 30 hours, about 36 hours, about 42 hours, about 48 hours, about 60 hours, or about 72 hours.

Re-ageing temperatures may be the same or different than those used for pre-ageing but re-ageing is generally conducted for a greater amount of time. In some aspects, the re-ageing step may be conducted as part of a warm forming step.

In some aspects, the aluminum alloy product may be locally recrystallized and solutionized by heat treatment. To improve bendability of the aluminum alloy product, the product may be subjected to a local laser treatment.

Gauges of aluminum alloy products produced with the described methods can be up to 15 mm in thickness. For example, the gauges of aluminum alloy products produced with the disclosed methods can be 15 mm, 14 mm, 13 mm, 12 mm, 11 mm, 10 mm, 9 mm, 8 mm, 7 mm, 6 mm, 5 mm, 4 mm, 3.5 mm, 3 mm, 2 mm, 1 mm, or any gauge less than 1 mm in thickness for example, 0.9 mm, 0.8 mm, 0.7 mm, 0.6 mm, 0.5 mm, 0.4 mm, 0.3 mm, 0.2 mm, or 0.1 mm. Starting thicknesses can be up to 20 mm. In some examples, the aluminum alloy products produced with the described methods can have a final gauge between about 2 mm to about 14 mm.

Methods of Using

The alloys and methods described herein can be used in automotive, electronics, and transportation applications, such as commercial vehicle, aircraft, or railway applications, or other applications. For example, the alloys could be used for chassis, cross-member, and intra-chassis components (encompassing, but not limited to, all components between the two C channels in a commercial vehicle chassis) to gain strength, serving as a full or partial replacement of high-strength steels. In certain examples, the alloys can be used in T8x tempers. In certain aspects, the alloys are used with a stiffener to provide additional strength. In certain aspects, the alloys are useful in applications where the processing and operating temperature is approximately 150° C. or lower.

In certain aspects, the alloys and methods can be used to prepare motor vehicle body part products. For example, the disclosed alloys and methods can be used to prepare automobile body parts, such as bumpers, side beams, roof beams, cross beams, pillar reinforcements (e.g., A-pillars, B-pillars, and C-pillars), inner panels, side panels, floor panels, tunnels, structure panels, reinforcement panels, inner hoods, battery plates or boxes, rocker components, or trunk lid panels. The disclosed aluminum alloys and methods can also be used in aircraft or railway vehicle applications, to prepare, for example, external and internal panels. In certain aspects, the disclosed alloys can be used for other specialties applications.

In certain aspects, the products created from the alloys and methods can be coated. For example, the disclosed products can be Zn-phosphated and electrocoated (E-coated). As part of the coating procedure, the coated samples can be baked to dry the E-coat at about 180° C. for about 20 minutes. In certain aspects, a paint bake response is observed wherein the alloys exhibit an increase in yield strength. In certain examples, the paint bake response is affected by the quenching methods during plate, shate or sheet forming.

The described alloys and methods can also be used to prepare housings for electronic devices, including mobile phones and tablet computers. For example, the alloys can be used to prepare housings for the outer casing of mobile phones (e.g., smart phones) and tablet bottom chassis, with or without anodizing. Exemplary consumer electronic products include mobile phones, audio devices, video devices, cameras, laptop computers, desktop computers, tablet computers, televisions, displays, household appliances, video playback and recording devices, and the like. Exemplary consumer electronic product parts include outer housings (e.g., facades) and inner pieces for the consumer electronic products.

The described alloys and methods can also be used to prepare extrusions, wire drawings, and forgings.

The following examples will serve to further illustrate the invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

Experiment 1

An exemplary alloy (Alloy A) including 0.92 wt. % Mg, 0.23 wt. % Fe, 0.83 wt. % Si, 0.78 wt. % Cu, 0.14 wt. % Mn, 0.12 wt. % Cr and 0.15 wt. % other impurities, with the remainder Al, was prepared as follows. An as-cast aluminum alloy ingot was homogenized at a temperature between about 520° C. and about 580° C. for at least 12 hours; the homogenized ingot was then hot rolled to an intermediate gauge by performing 16 passes through a hot roll mill, wherein the ingot entered the hot roll mill at a temperature between about 500° C. and about 540° C. and exited the hot roll mill at a temperature between about 30° C. and 400° C. to produce an intermediate gauge aluminum alloy; the intermediate gauge aluminum alloy was then optionally cold rolled to an aluminum alloy product having a first gauge between about 2 mm and about 4.5 mm; the aluminum alloy product was solutionized at a temperature between about 520° C. and 590° C.; the product was quenched, either with water and/or air. The product was then under-aged at 180° C. for 1 hour, cold rolled to a final gauge (i.e., the products were subjected to a cold reduction); and then re-aged for 48 hours at 100° C.

A second alloy (Alloy B) was prepared having the same composition as Alloy A, except that the under-ageing was conducted for 2 hours. Alloys A and B were then tested for yield strength (Rp), tensile strength (Rm), uniform elongation (Ag), and elongation (A80). Tensile strength was tested according to ISO 6892-1:2009(E) method B. The results are shown in Table 16 below:

TABLE 16

| | Rp (MPa) | Rm (MPa) | Ag (%) | A80 (%) |
|---|---|---|---|---|
| Sample A (0° to RD) | 515 | 539 | 6.0 | 8.2 |
| Sample B (0° to RD) | 543 | 556 | 1.5 | 5.3 |
| Sample B (90° to RD) | 522 | 551 | 4.1 | 8.2 |

Experiment 2

An exemplary alloy (Alloy C) was prepared using the same method used to prepare Alloy B except that there was a waiting time of 10 minutes to 1 hour between solution heat treatment and cold rolling, and that the sample was cold rolled.

An exemplary alloy (Alloy D) was prepared using the same method as Alloy C, except that the under-ageing was conducted at 160° C. for 8 hours and the re-ageing was conducted at 140° C. for 10 hours.

Alloys C and D were tested using the same tests as those applied to Alloys A and B. The test results are shown in Table 17 below and in FIG. 2A (showing the results at 0° to RD for Alloy C) and in FIG. 2B (showing the results at 90° to RD for Alloy C). Alloy C was tested with 10 minutes of waiting time, 2 hours of waiting time, and 1 day of waiting time between solution heat treatment and under-ageing treatment.

TABLE 17

| | Rp (MPa) | Rm (MPa) | Ag (%) | A80 (%) |
|---|---|---|---|---|
| Sample C (0° to RD) | | | | |
| 10 minutes | 545 | 557 | 1.2 | 3.7 |
| 2 hours | 535 | 547 | 3.4 | 6.2 |
| 1 day | 521 | 536 | 4.4 | 6.7 |
| Sample C (90° to RD) | | | | |
| 10 minutes | 514 | 546 | 3.7 | 7.4 |
| 2 hours | 505 | 537 | 4.6 | 8.0 |
| 1 day | 493 | 528 | 5.1 | 8.0 |

Figure 2A:
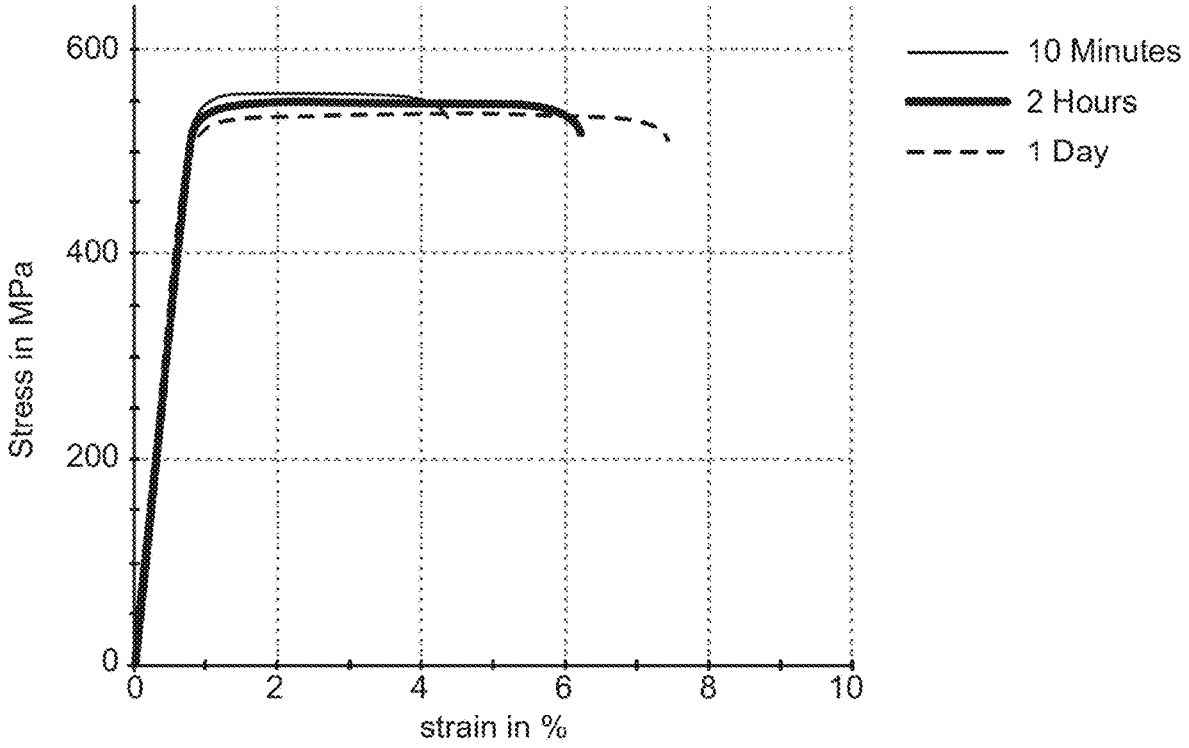
FIG. 2A is a graph showing the role of increasing the time between solution treatment and under-ageing treatment on strength at 0° to rolling direction (RD) according to one example.
Figure 2B:
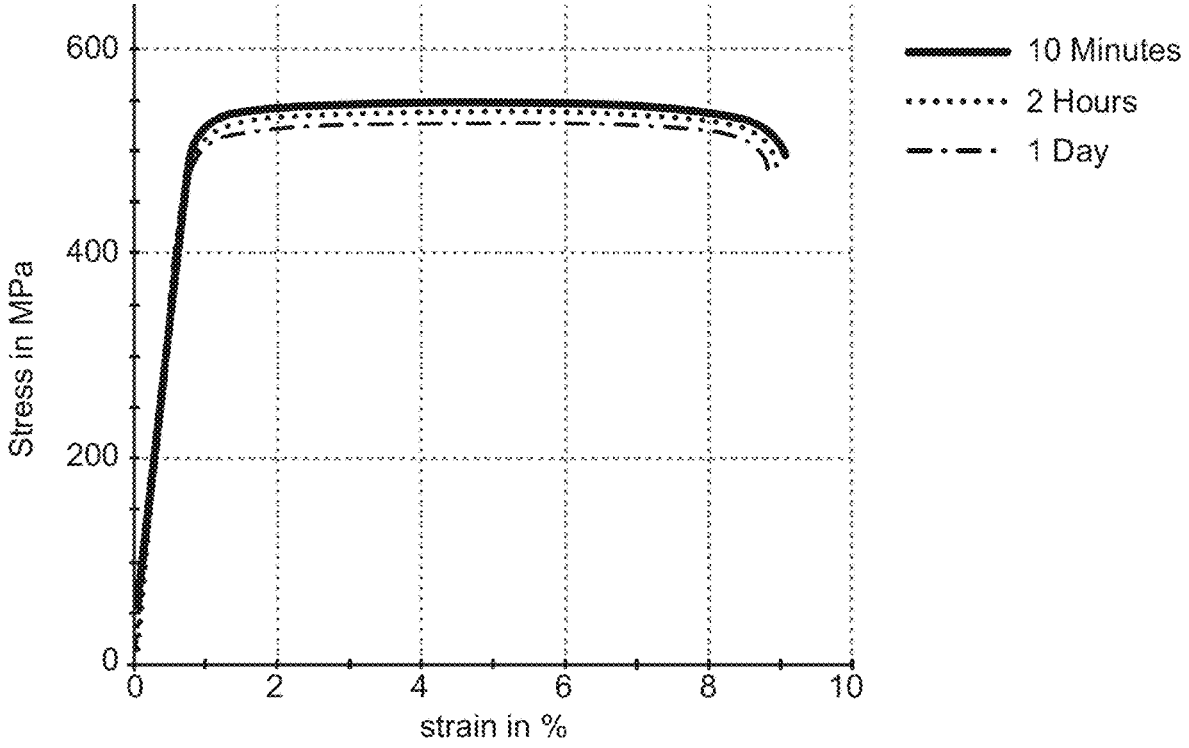
FIG. 2B is a graph showing the role of increasing the time between solution treatment and under-ageing treatment on strength at 90° to rolling direction (RD) according to one example.

As shown in Table 17 and in FIGS. 2A and B, increasing the time between solution treatment and under-ageing reduces the strength of the delivery temper, indicating the role of natural ageing after solution heat treatment.

Figure 3A:
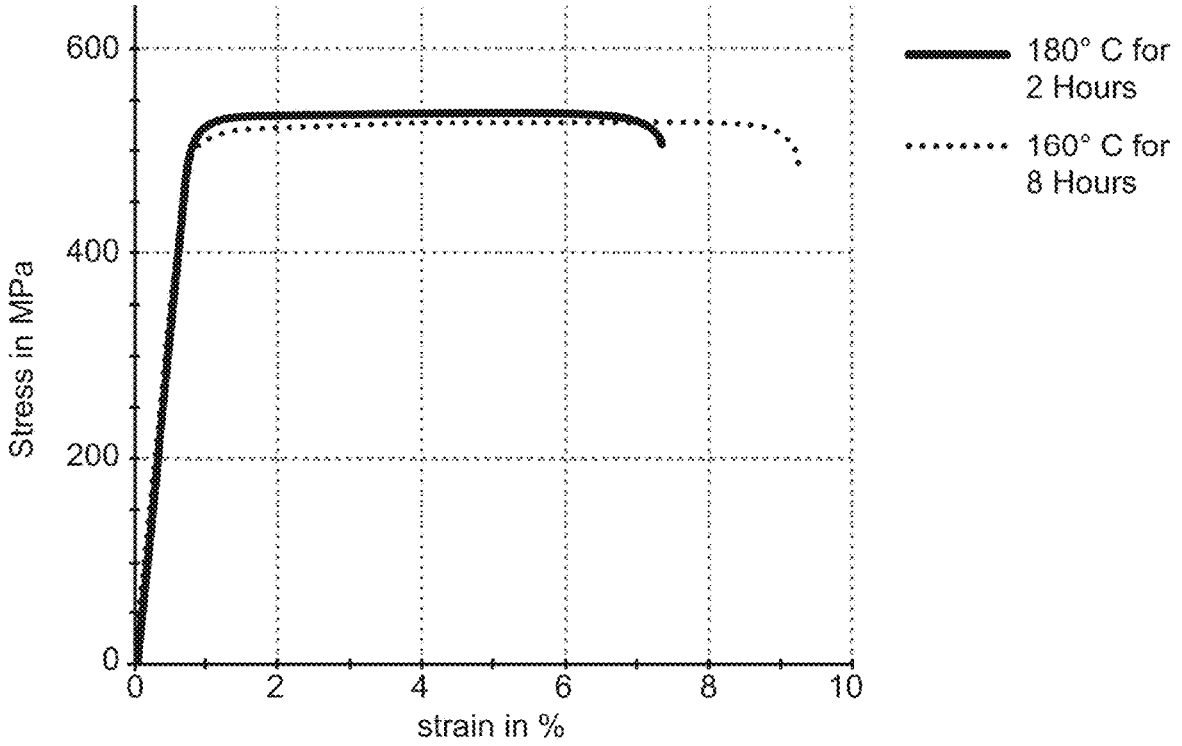
FIG. 3A is a graph showing the role of time and temperature during heat treatment on strength at 0° to rolling direction (RD) according to one example.
Figure 3B:
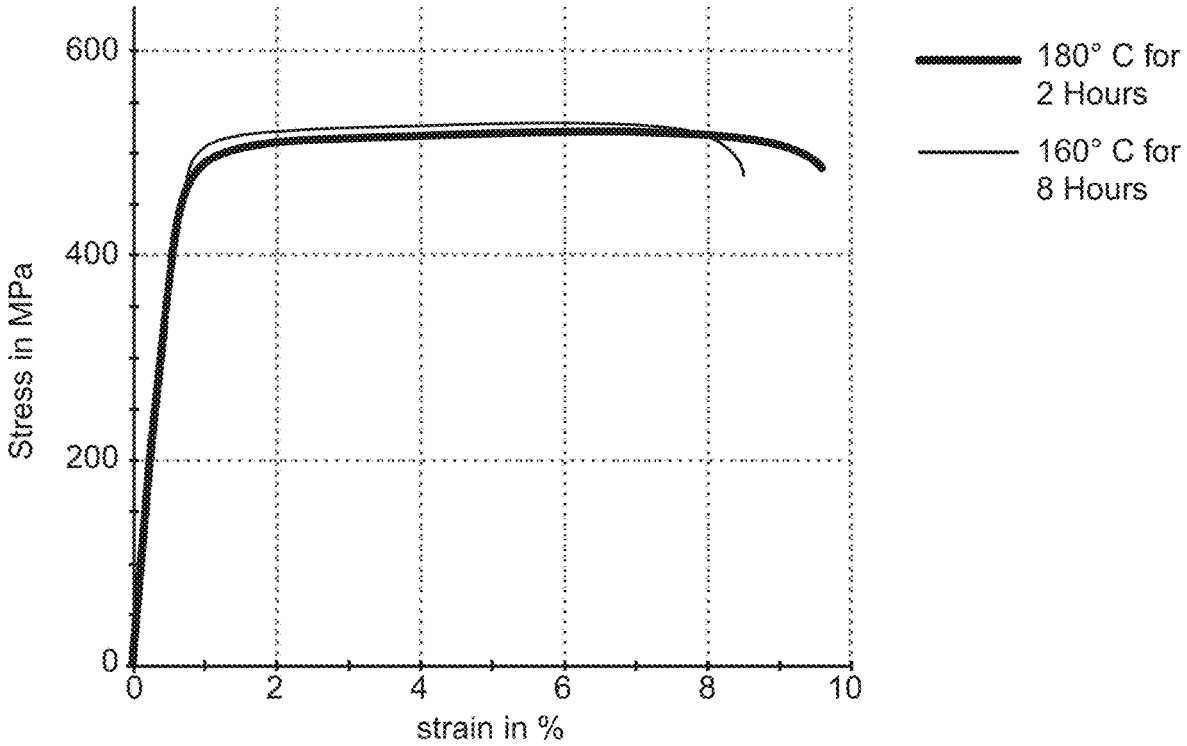
FIG. 3B is a graph showing the role of time and temperature during heat treatment on strength at 90° to rolling direction (RD) according to one example.

Alloys C and D were compared to determine the effect of a longer heat treatment at a lower temperature. The results are shown in Table 18 below and in FIGS. 3A and B.

TABLE 18

| | Rp (MPa) | Rm (MPa) | Ag (%) | A80 (%) |
|---|---|---|---|---|
| Sample C (0° to RD) | | | | |
| Alloy C | 521 | 536 | 4.4 | 6.7 |
| Alloy D | 510 | 529 | 5.3 | 8.5 |
| Sample C (90° to RD) | | | | |
| Alloy C | 493 | 528 | 5.1 | 8.0 |
| Alloy D | 482 | 521 | 5.7 | 9.0 |

Figure 4A:
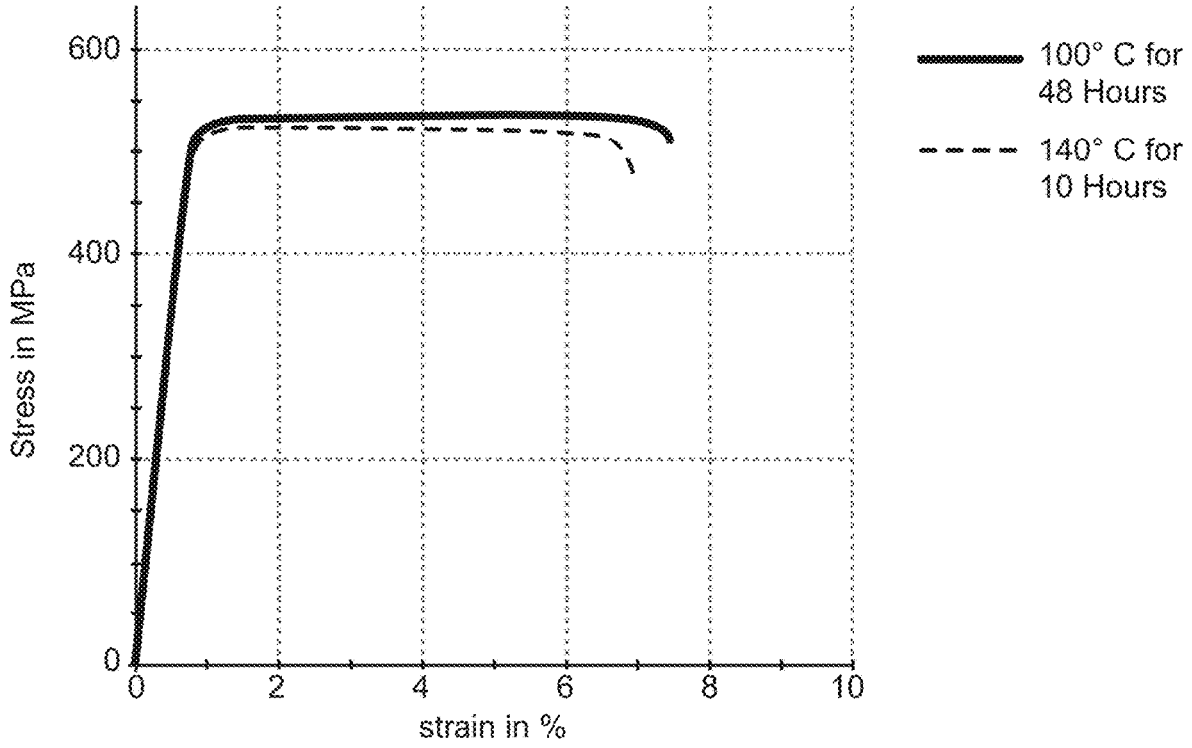
FIG. 4A is another graph showing the role of time and temperature during heat treatment on strength at 0° to rolling direction (RD) according to one example.
Figure 4B:
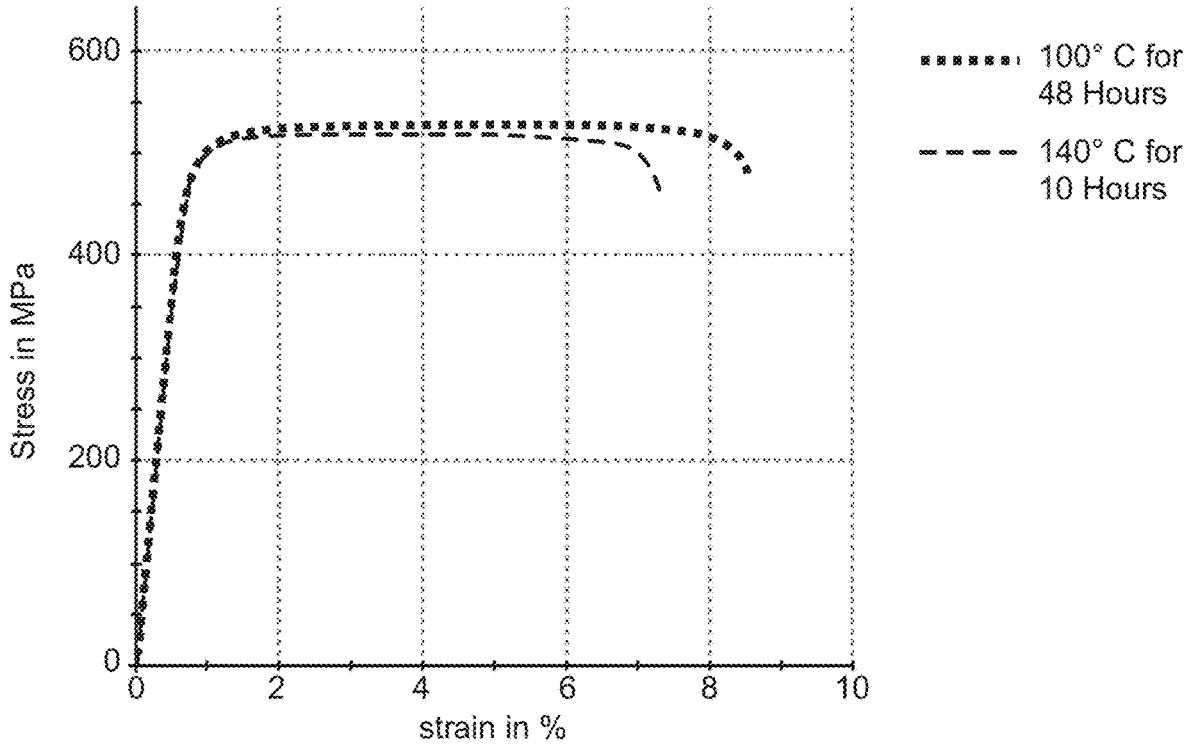
FIG. 4B is another graph showing the role of time and temperature during heat treatment on strength at 90° to rolling direction (RD) according to one example.

Table 19 and FIGS. 4A and B show the effect of varying the re-ageing time and temperature (from 100° C. for 48 hours to 140° C. for 10 hours).

TABLE 19

| | Rp (MPa) | Rm (MPa) | Ag (%) | A80 (%) |
|---|---|---|---|---|
| Sample C (0° to RD) | | | | |
| Alloy C | 521 | 536 | 4.4 | 6.7 |
| Alloy D | 514 | 524 | 2.1 | 6.4 |
| Sample C (90° to RD) | | | | |
| Alloy C | 493 | 528 | 5.1 | 8.0 |
| Alloy D | 495 | 517 | 3.5 | 6.5 |

Experiment 3

An exemplary alloy composition (Alloy E) including 0.88 wt. % Mg, 0.25 wt. % Fe, 0.70 wt. % Si, 0.91 wt. % Cu, 0.12 wt. % Mn, 0.15 wt. % Cr, 0.15 wt. % impurities, and the remainder Al was prepared as follows. An as-cast aluminum alloy ingot was homogenized at a temperature between about 520° C. and about 580° C. for at least 12 hours; the homogenized ingot was then hot rolled to an intermediate gauge by performing 16 passes through a hot roll mill, wherein the ingot entered the hot roll mill at a temperature between about 500° C. and about 540° C. and exited the hot roll mill at a temperature between about 30° C. and 400° C. to produce an intermediate gauge aluminum alloy; the intermediate gauge aluminum alloy was then optionally cold rolled to an aluminum alloy product having a first gauge between about 2 mm and about 4.5 mm; the aluminum alloy product was solutionized at a temperature between about 520° C. and 590° C.; the product was quenched, either with water and/or air.

Various pre-ageing, waiting times, under-ageing, and re-ageing treatments were then conducted as described below.

First, Alloy E was pre-aged at 120° C. for 1 hour. Then, the sample was held for 3 days before an under-ageing treatment was conducted at 160° C. for 8 hours. The sample was cold rolled from a gauge of approximately 3 mm to a final gauge between 2.5 mm and 1.7 mm. The sample was then re-aged at 140° C. for 10 hours. The longitudinal and transverse results are shown in Table 20 below. For the 5.1 gauge sample, the initial gauge was 9.5 mm, no pre-ageing was conducted, and the solution heat treatment was conducted at 550° C. for 1 hour with a water quench.

TABLE 20

| Gauge (mm) | CW (%) | Rp 0.2 (MPa) | Rm (MPa) | Ag (%) | A80 (%) |
|---|---|---|---|---|---|
| Longitudinal | | | | | |
| 5.1 | 46 | 429 | 499 | 7.5 | 12.1 |
| 2.5 | 17 | 437 | 467 | 7.6 | 11.4 |
| 2.0 | 32 | 479 | 497 | 5.3 | 8.5 |
| 1.7 | 43 | 490 | 505 | 4.2 | 6.7 |
| Transverse | | | | | |
| 5.1 | 47 | 424 | 487 | 7.8 | 13.0 |
| 2.5 | 17 | 408 | 460 | 7.6 | 11.0 |
| 2.0 | 32 | 443 | 484 | 5.7 | 8.9 |
| 1.7 | 43 | 458 | 494 | 5.0 | 7.5 |

Next, the role of solution heat treatment, pre-ageing, and waiting time between solution heat treatment and under-ageing was studied. Solution heat treatment was conducted at 550° C. for 1 hour or 60 seconds.

Figure 5:
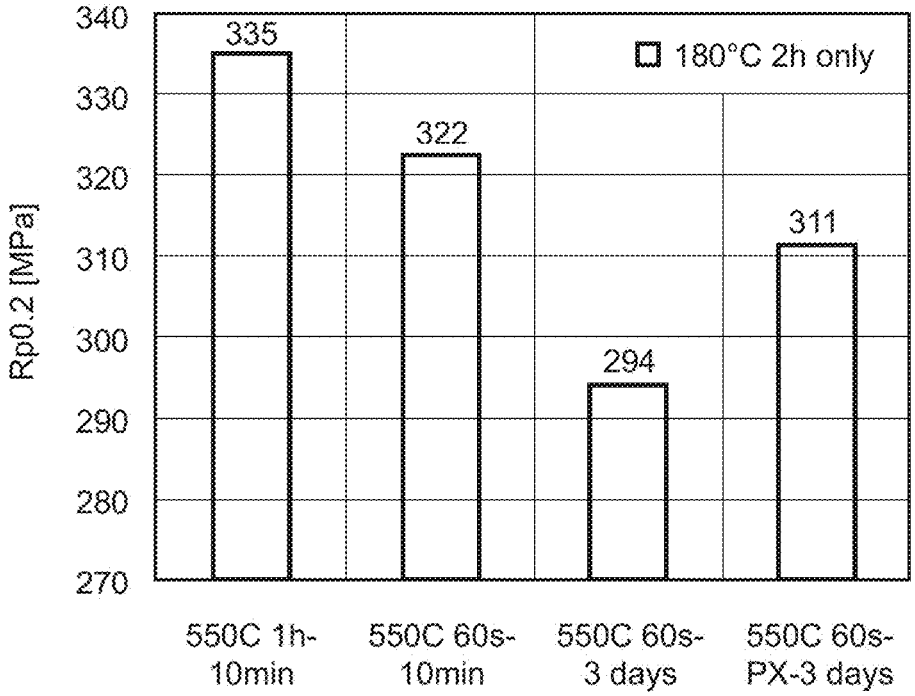
FIG. 5 is a graph showing strength after under-ageing with varied waiting time between solution heat treatment and under-ageing according to one example.
Figure 6:
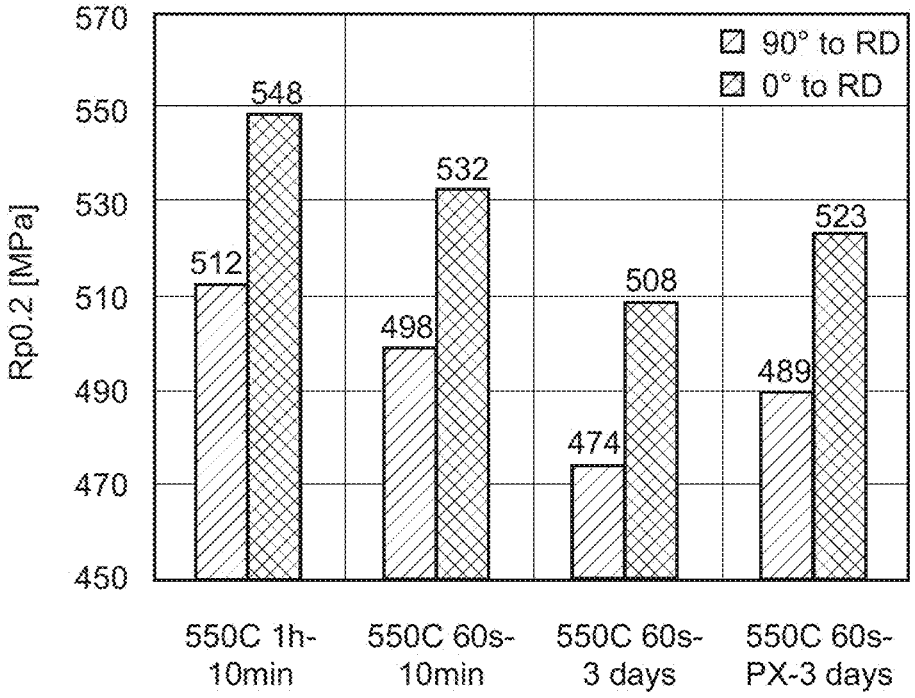
FIG. 6 is a graph showing the final temper strength of the samples in FIG. 5 according to one example.

As shown in FIGS. 5 and 6, the strength after under-ageing was measured with a 1 hour solution heat treatment, no pre-ageing and a 10 minute waiting period; with a 60 second solution heat treatment, no pre-ageing and a 10 minute waiting period; with a 60 second solution heat treatment, no pre-ageing, and a 3 day waiting period; and with a 60 second solution heat treatment, pre-ageing at 120° C. for 1 hour, and a three day waiting period. FIG. 5 indicates that the best strength was achieved with a longer solution heat treatment. For a shorter solution heat treatment, an increased waiting period decreased strength, though pre-ageing mitigated the effect of the increased waiting period (comparing 322 to 311 Rp 0.2 MPa). FIG. 6 indicates that the same trend is followed in the strength of the final temper. FIG. 6 indicates the results at 90° to RD and at 0° to RD.

Figure 7:
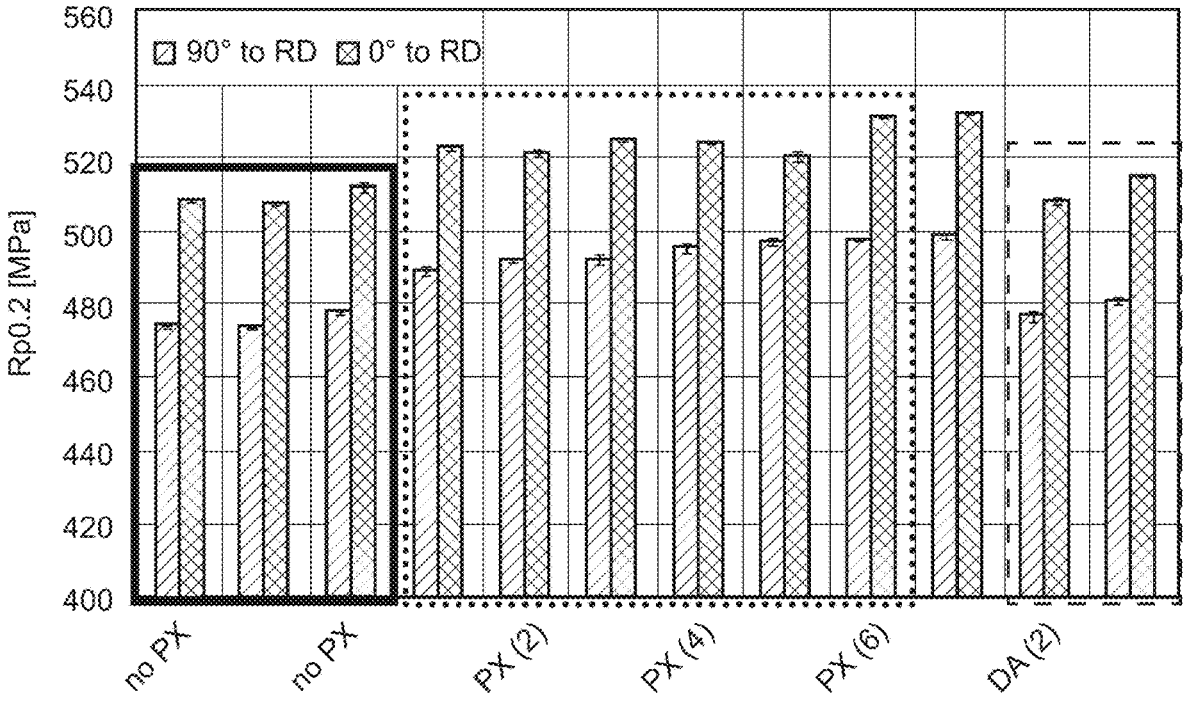
FIG. 7 is a graph showing the role of under-ageing and re-ageing on strength according to one example.
Figure 8:
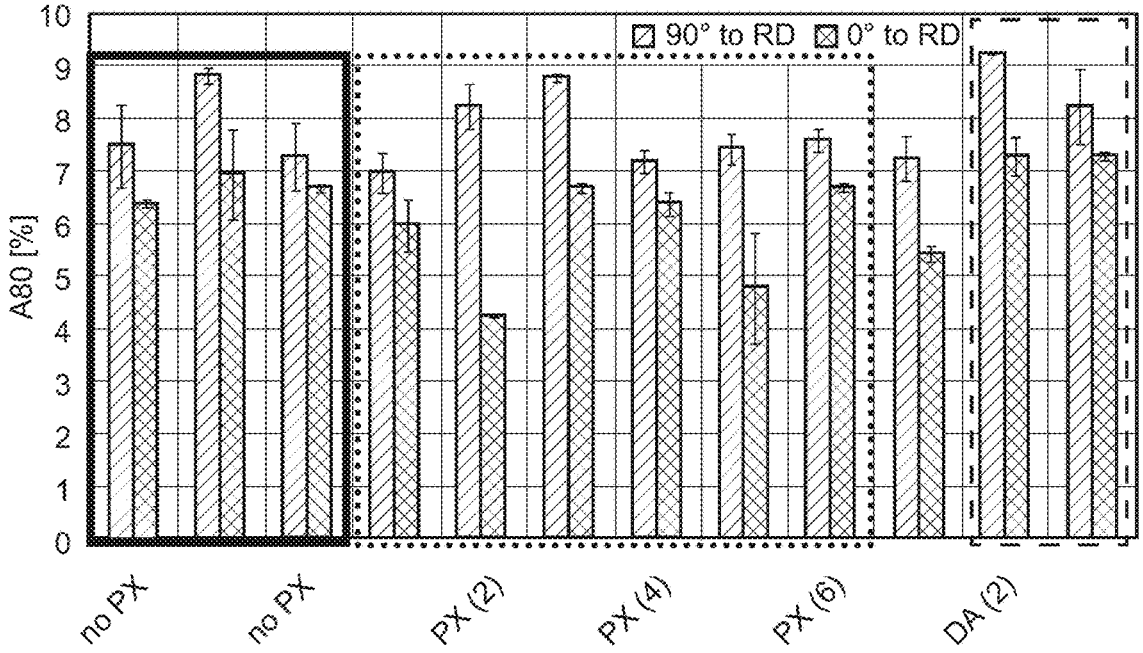
FIG. 8 is a graph showing the role of under-ageing and re-ageing on elongation according to one example.

An exemplary Alloy F was prepared using varied treatments as shown below in Table 21. In each test, solution heat treatment was conducted at 550° C. for 60 seconds with a water quench and the sample was cold rolled to 1 mm. The conditions are shown in Table 21 and the results are shown in FIGS. 7 and 8. Samples 11 and 12 were sent directly from quenching to heat treatment, referred to as direct ageing. Such direct ageing simulates holding the sample at the pre-ageing temperature for a relatively long amount of time (24 and 48 hours as reported) to achieve the desired strength.

TABLE 21

| Treatment | Pre-Ageing Temp (° C.) | Pre-Ageing Time (Hours) | Waiting period | Under-Ageing Temp (° C.) | Under-Ageing Time (Hours) | Re-Ageing Temp. (° C.) | Re-Ageing Time (Hours) |
|---|---|---|---|---|---|---|---|
| 1 | — | — | 3 days | 180 | 2 | 100 | 48 |
| 2 | — | — | 3 days | 160 | 8 | 100 | 48 |
| 3 | — | — | 3 days | 160 | 12 | 100 | 48 |
| 4 | 120 | 1 | 3 days | 180 | 2 | 100 | 48 |
| 5 | 120 | 1 | 3 days | 160 | 8 | 100 | 48 |
| 6 | 120 | 1 | 3 days | 160 | 8 | 120 | 10 |
| 7 | 120 | 1 | 3 days | 160 | 8 | 130 | 10 |
| 8 | 120 | 1 | 3 days | 160 | 8 | 140 | 10 |
| 9 | 120 | 1 | 3 days | 160 | 12 | 100 | 48 |
| 10 | — | — | 10 min | 180 | 2 | 100 | 48 |
| 11 | 120 | 24 | — | — | — | 100 | 48 |
| 12 | 120 | 48 | — | — | — | 100 | 48 |

As shown in FIG. 7, the strength was decreased when a pre-ageing treatment was not included and when an under-ageing treatment was not included. As shown in FIG. 8, the elongation did not have any major differences between the variants. FIGS. 7 and 8 indicate the results at 90° to RD and at 0° to RD.

Experiment 4

An exemplary alloy composition (Alloy G) of AA7075 was prepared as a 3.95 mm thick sheet with an F temper (as fabricated) using a solutionizing heat treatment of 480° C. for 30 minutes followed by quenching. Various pre-ageing, waiting times, under-ageing, and re-ageing treatments were then conducted as described below.

Figure 9:
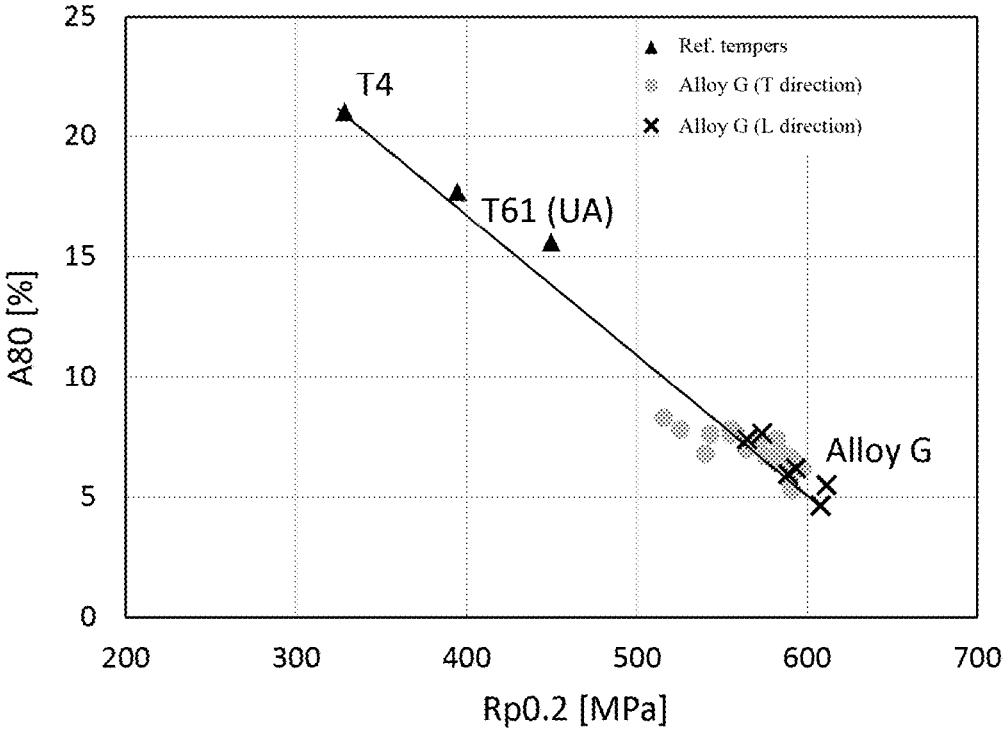
FIG. 9 is a graph showing the role of under-ageing and re-ageing on strength and elongation according to one example.

First, Alloy G was under-aged at 100° C. for 8 hours, followed by 120° C. for 8 hours. The sample was cold rolled to an approximately 50% reduction in thickness to 2 mm. The sample was then re-aged at 120° C. for 4 hours. The longitudinal (L) and transverse (T) results for the under-aged, cold rolled, and re-aged materials are shown in FIG. 9 compared with conventional AA7075 (no under-aging, cold rolling, and re-aging process) at a T4 and T61 (under-aged) temper used as a reference (ref. tempers in FIG. 9). As shown in FIG. 9, strength as measured by Rp0.2 (MPa) in the L and T directions increased significantly for the Alloy G samples undergoing the under-aging, cold rolling, and re-aging process with limited reduction in elongation (A80).

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art. As used below, any reference to a series of examples is to be understood as a reference to each of those examples disjunctively (e.g., "Examples 1-4" is to be understood as "Examples 1, 2, 3, or 4").

Example 1 is a method of making an aluminum alloy product, comprising: casting a 6xxx aluminum alloy; heating the cast aluminum alloy to a temperature of 510° C. to 580° C.; maintaining the cast aluminum alloy at the temperature of 510° C. to 580° C. for at least 0.5 hours; hot rolling the cast aluminum alloy into the aluminum alloy product, the rolled aluminum alloy product having a thickness up to 12 mm at a hot roll exit temperature of 250° C. to 400° C.; cold rolling to a first gauge; heat treating the aluminum alloy product at a temperature of 520° C. to 590° C.; quenching the aluminum alloy product to ambient temperature; under-ageing the aluminum alloy product; and cold rolling the aluminum alloy product.

Example 2 is a method of making an aluminum alloy product, comprising: casting a 6xxx aluminum alloy; heating the cast aluminum alloy to a temperature of 510° C. to 580° C.; maintaining the cast aluminum alloy at the temperature of 510° C. to 580° C. for at least 0.5 hours; hot rolling the cast aluminum alloy into the aluminum alloy product and quenching, the rolled aluminum alloy product having a thickness up to 12 mm at a quenching exit temperature of 150° C. to 300° C.; under-ageing the aluminum alloy product; and cold rolling the aluminum alloy product.

Example 3 is a method of making an aluminum alloy product, comprising: continuously casting a 6xxx aluminum alloy at a first speed; optionally subjecting the cast aluminum alloy to a post-casting quenching; optionally coiling the cast aluminum alloy into a coil; hot rolling the cast aluminum alloy at a second speed; optionally heating the cast aluminum alloy to a temperature of 510° C. to 580° C.; optionally quenching the cast aluminum alloy to form the aluminum alloy product; under-ageing the aluminum alloy product; and cold rolling the aluminum alloy product.

Example 4 is the method of example 3, wherein the cast aluminum alloy is heated and soaked prior to hot rolling.

Example 5 is the method of any of example(s) 1-4, further comprising pre-ageing the quenched aluminum alloy.

Example 6 is the method of any of example(s) 1-5, further comprising: re-ageing the aluminum alloy product.

Example 7 is the method of example(s) 6, wherein the re-ageing is at a temperature from 90° C. to 200° C.

Example 8 is the method of example(s) 6, wherein the re-ageing is conducted from 1 to 72 hours.

Example 9 is the method of any of example(s) 1-3, wherein the under-ageing is at a temperature from 90° C. to 200° C.

Example 10 is the method of any of example(s) 1-3, wherein the under-ageing is conducted from 1 to 72 hours.

Example 11 is the method of any of example(s) 1-3, wherein the % cold working is 10% to 80%.

Example 12 is the method of any of example(s) 1-11, wherein the 6xxx aluminum alloy comprises about 0.6-1.0 wt. % Cu, about 0.8-1.5 wt. % Si, about 0.8-1.5 wt. % Mg, about 0.03-0.25 wt. % Cr, about 0.05-0.25 wt. % Mn, about 0.15-0.4 wt. % Fe, up to about 0.2 wt. % Zr, up to about 0.2 wt. % Sc, up to about 0.25 wt. % Sn, up to about 0.9 wt. % Zn, up to about 0.1 wt. % Ti, up to about 0.07 wt. % Ni, and up to about 0.15 wt. % of impurities, with the remainder as Al.

Example 13 is the method of any of example(s) 1-11, wherein the 6xxx aluminum alloy comprises about 0.65-0.9 wt. % Cu, about 0.9-1.15 wt. % Si, about 0.8-1.3 wt. % Mg, about 0.03-0.09 wt. % Cr, about 0.05-0.18 wt. % Mn, about 0.18-0.25 wt. % Fe, about 0.01-0.2 wt. % Zr, up to about 0.2 wt. % Sc, up to about 0.2 wt. % Sn, about 0.001-0.9 wt. % Zn, up to about 0.1 wt. % Ti, up to about 0.05 wt. % Ni, and up to about 0.15 wt. % of impurities, with the remainder as Al.

Example 14 is the method of any of example(s) 1-11, wherein the aluminum alloy comprises about 0.65-0.9 wt. % Cu, about 1.0-1.1 wt. % Si, about 0.8-1.25 wt. % Mg, about 0.05-0.07 wt. % Cr, about 0.08-0.15 wt. % Mn, about 0.15-0.2 wt. % Fe, about 0.01-0.15 wt. % Zr, up to about 0.15 wt. % Sc, up to about 0.2 wt. % Sn, about 0.004-0.9 wt. % Zn, up to about 0.03 wt. % Ti, up to about 0.05 wt. % Ni, and up to about 0.15 wt. % of impurities, with the remainder as Al.

Example 15 is a 6xxx aluminum alloy product, wherein the product is prepared by a method of any of example(s) 1-14.

Example 16 is a 6xxx aluminum alloy product of example 15, wherein the product has a yield strength of at least 450 MPa.

Example 17 is a 6xxx aluminum alloy product of example 15, wherein the product has a tensile strength of at least 500 MPa.

Example 18 is a 6xxx aluminum alloy product of example 15, wherein the product has an elongation of at least 5%.

Example 19 is an automotive body part comprising the aluminum alloy product of any of example(s) 15-18.

Example 20 is an electronic device housing comprising the aluminum alloy product of any of example(s) 15-18.

All patents, publications and abstracts cited above are incorporated herein by reference in their entirety. Various embodiments of the invention have been described in fulfillment of the various objectives of the invention. It should be recognized that these embodiments are merely illustrative of the principles of the invention. Numerous modifications and adaptations thereof will be readily apparent to those skilled in the art without departing from the spirit and scope of the present invention as defined in the following claims.

What is claimed is:

1. A method of making an aluminum alloy product, comprising:

casting a 6xxx series aluminum alloy;

heating the cast aluminum alloy to a temperature of 510° C. to 580° C.;

maintaining the cast aluminum alloy at the temperature of 510° C. to 580° C. for at least 0.5 hours to form a heated cast aluminum alloy;

hot rolling the heated cast aluminum alloy into a hot rolled aluminum alloy product, the hot rolled aluminum alloy product having a thickness up to 12 mm at a hot roll exit temperature of 250° C. to 400° C.;

cold rolling the hot rolled aluminum alloy product to form a cold rolled aluminum alloy product at a first gauge;

heat treating the cold rolled aluminum alloy product at a first gauge at a temperature of 520° C. to 590° C. to form a heat treated aluminum alloy product;

quenching the heat treated aluminum alloy product to ambient temperature to form a quenched aluminum alloy product;

under-ageing the quenched aluminum alloy product by under-ageing at a temperature from 155° C. to 200° C. for a time from 1 to 36 hours to form an under-aged aluminum alloy product; and cold rolling the under-aged aluminum alloy product to form a cold rolled aluminum alloy product at a second gauge; and re-aging the cold rolled aluminum alloy product at a second gauge at a temperature from 50° C. to 130° C. for a time of up to 72 hours.

2. A method of making an aluminum alloy product, comprising:

casting a 6xxx series aluminum alloy;

heating the cast aluminum alloy to a temperature of 510° C. to 580° C.;

maintaining the cast aluminum alloy at the temperature of 510° C. to 580° C. for 0.5 to 100 hours to form a heated cast aluminum alloy;

hot rolling the cast aluminum alloy into a hot rolled aluminum alloy product and quenching the hot rolled aluminum alloy product to form a quenched aluminum alloy product, the quenched aluminum alloy product having a thickness up to 12 mm at a quenching exit temperature of 150° C. to 300° C.;

under-ageing the quenched aluminum alloy product by under-ageing at a temperature from 155° C. to 200° C. for a time from 1 to 36 hours to form an under-aged aluminum alloy product;

cold rolling the quenched aluminum alloy product to form a cold rolled aluminum alloy product; and re-aging the cold rolled aluminum alloy product at a temperature from 50° C. to 130° C. for a time of up to 72 hours.

3. The method of claim 2, further comprising:

subjecting the cast aluminum alloy to a post-casting quenching before heating the cast aluminum alloy to a temperature of 510° C. to 580° C., wherein the casting step involves continuously casting the aluminum alloy.

4. The method of claim 3, further comprising:

coiling the quenched cast aluminum alloy into a coil before heating the cast aluminum alloy to a temperature of 510° C. to 580° C.

5. A method of making an aluminum alloy product, comprising:

casting a 6xxx series aluminum alloy;

heating the cast aluminum alloy to a temperature of 400° C. to 600° C.;

maintaining the cast aluminum alloy at the temperature of 400° C. to 600° C. for 0.5 to 100 hours to form a heated aluminum alloy;

hot rolling the cast aluminum alloy into a hot rolled aluminum alloy product and quenching to form a quenched aluminum alloy product, the quenched aluminum alloy product having a thickness up to 12 mm at a quenching exit temperature of 30° C. to 400° C.;

under-ageing the quenched aluminum alloy product by under-ageing at a temperature from 155° C. to 200° C. for a time from 1 to 36 hours to form an under-aged aluminum alloy product;

cold rolling the under aged aluminum alloy product to form a cold rolled aluminum alloy product; and re-aging the cold rolled aluminum alloy product at a temperature from 50° C. to 130° C. for a time of up to 72 hours.

6. The method of claim 5, further comprising pre-ageing the quenched aluminum alloy product.

7. The method of claim 5, wherein the % reduction from cold rolling is 10% to 80%.

8. The method of claim 1, wherein the 6xxx series aluminum alloy comprises 0.6-1.0 wt. % Cu, 0.5%-1.5 wt.

% Si, 0.8-1.5 wt. % Mg, 0.03-0.25 wt. % Cr, 0.05-0.25 wt. % Mn, 0.15-0.3 wt. % Fe, up to 0.2 wt. % Zr, up to 0.2 wt.0% Sc, up to 0.25 wt.0% Sn, up to 0.9 wt. % Zn, up to 0.1 wt. % Ti, up to 0.07 wt. % Ni, and up to 0.15 wt. % of impurities, with the remainder as Al.

9. The method of claim 1, wherein the 6xxx series aluminum alloy comprises 0.65-0.9 wt. % Cu, from 0.55-1.35 wt. % Si, 0.8-1.3 wt. % Mg, 0.03-0.09 wt. % Cr, 0.05-0.18 wt. % Mn, 0.18-0.25 wt. % Fe, 0.01-0.2 wt. % Zr, up to 0.2 wt. % Sc, up to 0.2 wt. % Sn, 0.001-0.9 wt. % Zn, up to 0.1 wt. % Ti, up to 0.05 wt. % Ni, and up to 0.15 wt. % of impurities, with the remainder as Al.

10. The method of claim 1, wherein the aluminum alloy comprises 0.65-0.9 wt. % Cu, from 0.6-1 0.24 wt. % Si, 0.8-1.25 wt. % Mg, 0.05-0.07 wt. % Cr, 0.08-0.15 wt. % Mn, 0.15-0.2 wt. % Fe, 0.01-0.5 wt. % Zr, up to 0.15 wt. % Sc, up to 0.2 wt. % Sn, 0.004-0.9 wt. % Zn, up to 0.03 wt. % Ti, up to 0.05 wt. % Ni, and up to 0.15 wt. % of impurities, with the remainder as Al.

* * * * *